US010309618B2

(12) United States Patent
Enno et al.

(10) Patent No.: US 10,309,618 B2
(45) Date of Patent: Jun. 4, 2019

(54) ILLUMINATING DEVICE

(71) Applicant: PANASONIC INTELLECTUAL PROPERTY MANAGEMENT CO., LTD., Osaka (JP)

(72) Inventors: Yoshimichi Enno, Osaka (JP); Hiroyuki Yoshioka, Osaka (JP); Katsunori Kawabata, Kyoto (JP); Takao Kondo, Osaka (JP); Kazuhiro Daijo, Osaka (JP); Koji Uenoyama, Kyoto (JP); Yoshihiro Muragaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 6 days.

(21) Appl. No.: 15/420,278

(22) Filed: Jan. 31, 2017

(65) Prior Publication Data

US 2017/0219186 A1 Aug. 3, 2017

(30) Foreign Application Priority Data

Feb. 1, 2016 (JP) ..... 2016-017398

(51) Int. Cl.
*F21V 14/06* (2006.01)
*F21V 29/74* (2015.01)
(Continued)

(52) U.S. Cl.
CPC ..... *F21V 14/06* (2013.01); *F21S 2/005* (2013.01); *F21V 5/007* (2013.01); *F21V 5/008* (2013.01);
(Continued)

(58) Field of Classification Search
CPC ..... F21V 14/06; F21V 29/74; F21V 2/005; F21V 5/007; F21V 5/008; F21V 7/043;
(Continued)

(56) References Cited

U.S. PATENT DOCUMENTS

2001/0028559 A1* 10/2001 Tenmyo ..... G03B 15/05 362/16
2008/0030974 A1* 2/2008 Abu-Ageel ..... F21V 5/008 362/19

FOREIGN PATENT DOCUMENTS

JP 2005-259653 9/2005

* cited by examiner

*Primary Examiner* — Julie A Bannan
(74) *Attorney, Agent, or Firm* — Greenblum & Bernstein, P.L.C.

(57) ABSTRACT

An illuminating device includes: first lenses individually corresponding to LEDs; a light control member including light transmission channels individually corresponding to the first lenses and a light blocker surrounding the light transmission channels; and second lenses individually corresponding to the light transmission channels. Each first lens includes a light concentrator for producing concentrated light by concentrating light emitted from a corresponding LED, and a reflector surrounding the light concentrator to produce reflected light by reflecting light emitted from the corresponding LED in a direction across the concentrated light. Each first lens outputs illumination light including the concentrated light and the reflected light produced from the corresponding light emitting diode. Each light transmission channel transmits the illumination light output from a corresponding first lens. The light blocker prevents transmission of the illumination light emitted from each first lens. Each second lens refracts the illumination light transmitted by a corresponding light transmission channel.

16 Claims, 14 Drawing Sheets

(51) Int. Cl.

| | |
|---|---|
| ***F21S 2/00*** | (2016.01) |
| ***F21V 5/00*** | (2018.01) |
| ***F21V 7/04*** | (2006.01) |
| ***F21V 11/00*** | (2015.01) |
| ***F21V 13/12*** | (2006.01) |
| ***F21V 17/12*** | (2006.01) |
| ***F21V 19/00*** | (2006.01) |
| *F21Y 115/10* | (2016.01) |

(52) U.S. Cl.
CPC ..... *F21V 7/043* (2013.01); *F21V 11/00* (2013.01); *F21V 13/12* (2013.01); *F21V 17/12* (2013.01); *F21V 19/0025* (2013.01); *F21V 19/0055* (2013.01); *F21V 29/74* (2015.01); *F21Y 2115/10* (2016.08)

(58) Field of Classification Search
CPC ..... F21V 11/00; F21V 13/12; F21V 17/12; F21V 19/0025; F21V 19/0055
USPC ..... 362/281
See application file for complete search history.

ILLUMINATING DEVICE

CROSS-REFERENCE TO RELATED APPLICATION

The present application is based upon and claims the benefit of priority of Japanese Patent Application No. 2016-017398, filed on Feb. 1, 2016, the entire contents of which are incorporated herein by reference.

TECHNICAL FIELD

The present disclosure relates to illuminating devices.

BACKGROUND ART

In the past, there has been proposed an illuminating device suitable including a light source including light emitting diodes (LEDs) (e.g., see JP 2005-259653 A (hereinafter referred to as "Document 1")). The illuminating device disclosed in Document 1 includes a casing with a box shape, a light source, a collimator lens part, and a fly eye lens, for example. The casing includes a top plate having a circular window hole, a pair of side plates protruding upright from opposite ends of the top plates, and a bottom plate which interconnects the pair of side plates and is positioned parallel to the top plate. The bottom plates has transmitting holes which have diameters smaller than a diameter of the window hole and are arranged in a matrix manner. The light source includes a circuit board with a rectangular plate shape, and bullet LEDs mounted on the circuit board. Tops of the bullet LEDs are inserted into the transmitting holes of the bottom plate, individually.

The illuminating device disclosed in Document 1 is configured to convert rays of light emitted from the light source into collimated rays of light by the collimator lens part and guide the collimated rays of light to the fly eye lens.

Recently, surface mounted LEDs and COB (Chip On Board) LEDs are the mainstream of LEDs for illumination. However, in a case where such surface mounted LEDs and COB LEDs are used as a light source, it may be difficult for the configuration disclosed in Document 1 to improve the usage efficiency of light emitted from LEDs and additionally improve the uniformity ratio of illumination light.

SUMMARY

An object of the present disclosure would be to propose an illuminating device capable of improving the usage efficiency of light emitted from LEDs and additionally improving the uniformity ratio of illumination light.

The illuminating device according to one aspect of the present disclosure includes light emitting diodes, a first lens array, a second lens array, and a light control member. The first lens array includes first lenses individually corresponding to the light emitting diodes. The light control member includes light transmission channels individually corresponding to the first lenses and a light blocker surrounding the light transmission channels. The second lens array includes second lenses individually corresponding to the light transmission channels. Each of the first lenses includes a light concentrator for producing concentrated light by concentrating a part of light emitted from a corresponding light emitting diode of the light emitting diodes, and a reflector surrounding the light concentrator to produce reflected light by reflecting another part of the light emitted from the corresponding light emitting diode in a direction across the concentrated light and being configured to output illumination light including the concentrated light and the reflected light. Each of the light transmission channels is for transmitting the illumination light output from a corresponding first lens of the first lenses. The light blocker is for preventing transmission of the illumination light emitted from each of the first lenses. Each of the second lenses is for refracting the illumination light transmitted by a corresponding light transmission channel of the light transmission channels.

BRIEF DESCRIPTION OF THE DRAWINGS

The figures depict one or more implementation in accordance with the present teaching, by way of example only, not by way of limitations. In the figures, like reference numerals refer to the same or similar elements.

DETAILED DESCRIPTION

Figure 1:
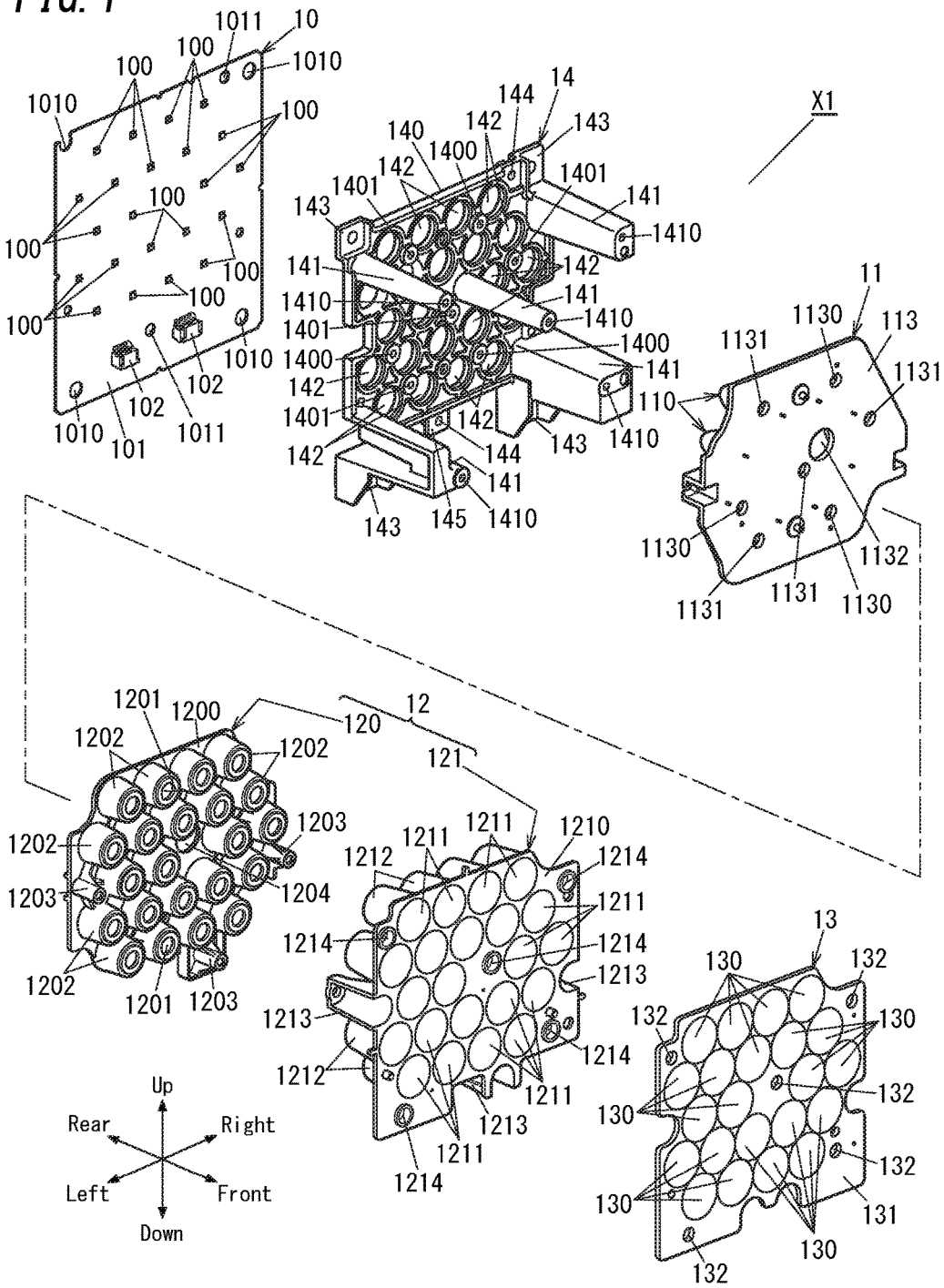
FIG. 1 is an exploded perspective view of an illuminating device according to Embodiment 1 of the present disclosure.
Figure 2:
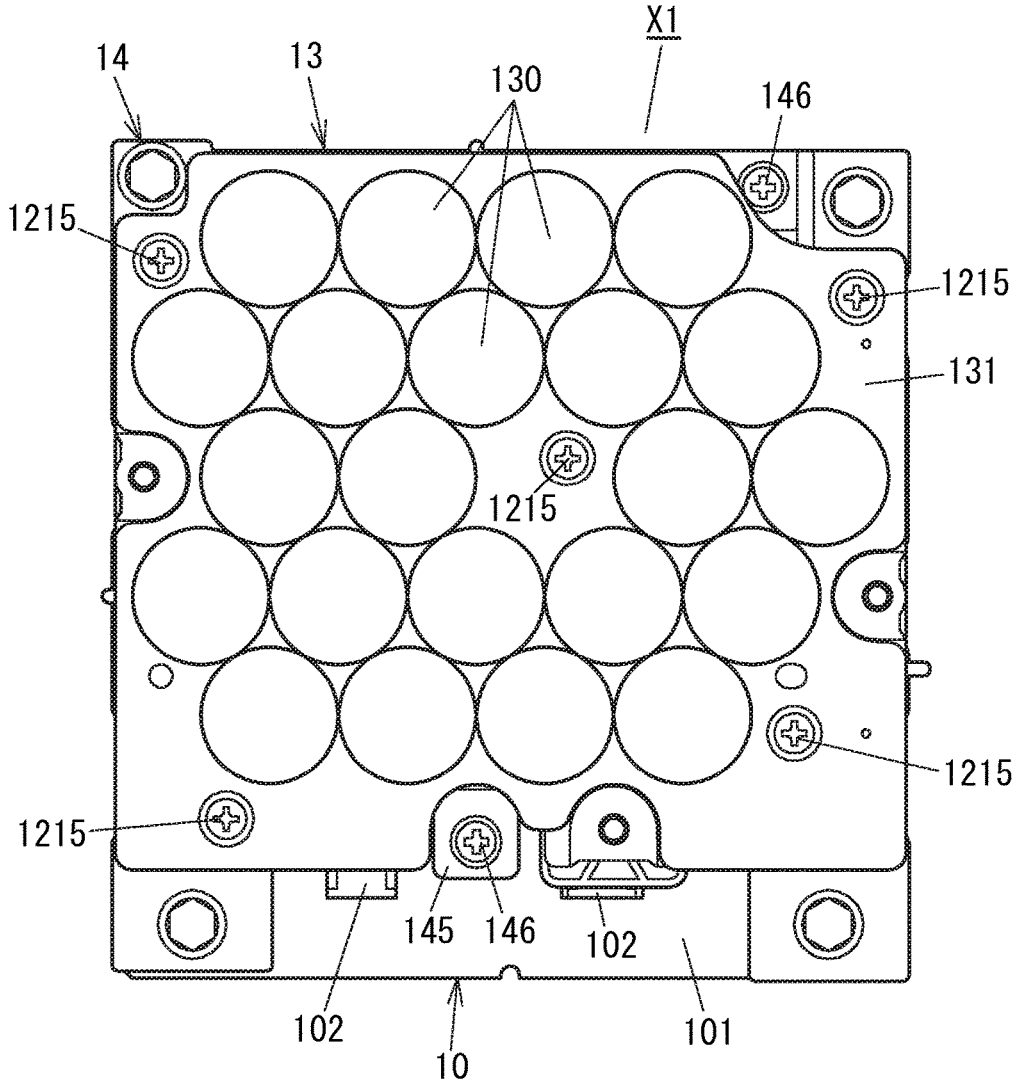
FIG. 2 is a front view of the illuminating device of the above.

The following embodiments relate to illuminating devices and particularly to an illuminating device including one or more light emitting diodes (LEDs). Note that, the configurations described in the following embodiments are examples according to the present disclosure. The present disclosure is not limited to the following embodiments, and the following embodiments can be modified in consideration of design or the like as long as they belong to the same technical concept derived from the present disclosure.

Embodiment 1

As shown in FIG. 1 to FIG. 5, the illuminating device X1 according to Embodiment 1 includes an LED module 10, a first lens array 11, a light control member 12, and a second lens array 13. Additionally, the illuminating device X1 may preferably include a supporting member 14. Note that, in the following description, unless otherwise noted, the forward, rearward, left, right, upward and downward directions of the illuminating device X1 correspond to those shown in FIG. 1.

The LED module 10 includes a printed wiring board 101 with a rectangular plate shape, and LEDs (in the illustrated example, twenty-two LEDs) 100 (see FIG. 1). Note that, the number of LEDs 100 is not limited to 22. There are circular through holes 1010 formed individually in four corners of the printed wiring board 101. Note that, a periphery of the through hole 1010 positioned in an upper left corner of the printed wiring board 101 is partially cut out. Each LED 100 includes an LED chip for emitting blue light, a surface-mounted package for accommodating the LED chip, and a resin part 1000 protruding from a surface of the package (see FIG. 5). The resin part 1000 is made of transparent synthetic resin such as silicone resin, and is formed into a hemispherical shape. Additionally, the resin part 1000 contains phosphor for converting blue light into yellow light. Thus, some of rays of blue light emitted from the LED chip are converted into yellow light by the phosphor. Accordingly, each LED 100 mixes blue light and yellow light and therefore emits white light. These twenty-two LEDs 100 are soldered to pads formed on a front face of the printed wiring board 101 and thereby mounted on the front face (hereinafter referred to as "mounting surface") of the printed wiring board 101. Further, it is preferable that there be two receptacle connectors 102 mounted on the mounting surface of the printed wiring board 101 (see FIG. 1). These two receptacle connectors 102 are individually and electrically connected to series circuits of eleven LEDs 100 through printed wires (conductors) formed on the mounting surface of the printed wiring board 101.

The first lens array 11 includes first lenses 110 the number of which is equal to the number of LEDs 100 (that is, 22), and a first support 113 (see FIG. 1). The first support 113 supports the first lenses 110. These twenty-two first lenses 110 each include a light concentrator 111 and a reflector 112 (see FIG. 5). In each of the first lenses 110, the light concentrator 111 and the reflector 112 are formed integrally. The light concentrator 111 may include preferably a collimator lens. The reflector 112 may preferably be formed into a hollow cylindrical shape so as to surround a light entrance surface 111*a* of the light concentrator 111. In short, the reflector 112 surrounds a light entrance surface 111*a* of the light concentrator 111. The reflector 112 may preferably be configured to cause internal total reflection of received light. The first lenses 110 and the first support 113 may be formed integrally of transparent synthetic resin such as acrylic resin.

The second lens array 13 includes second lenses 130 the number of which is equal to the number of LEDs 100 (that is, 22), and a second support 131 (see FIG. 1). The second support 131 supports the second lenses 130. These twenty-two second lenses 130 each may preferably include a plane-convex lens (see FIG. 3 to FIG. 5). The second lenses 130 and the second support 131 may be formed integrally of transparent synthetic resin such as acrylic resin.

The light control member 12 may preferably include at least a first light control member 120 and a second light control member 121 (see FIG. 1, and FIG. 3 to FIG. 5). The first light control member 120 includes a first light blocker 1200 and first light transmission channels 1201 the number of which is equal to the number of first lenses 110 (that is, 22). The first light control member 120 may further preferably include first hollow cylindrical parts 1202 the number of which is equal to the number of first light transmission channels 1201 (that is, 22). The first light blocker 1200 may be preferably formed into a flat plate shape of material which does not transmit light emitted from LEDs 100 (e.g., opaque synthetic resin). The first light transmission channels 1201 each may preferably a circular hole penetrating the first light blocker 1200 in a thickness direction of the first light blocker 1200 (see FIG. 5). The first hollow cylindrical parts 1202 may preferably protrude forward from peripheries of the first light transmission channels 1201 of a front face of the first light blocker 1200. Further, the first hollow cylindrical parts 1202 each may preferably have a circular tube shape, and have its diameter which becomes gradually smaller toward its front end (see FIG. 5). In other words, each of the first hollow cylindrical parts 1202 has a diameter which becomes smaller as a distance from the first light blocker 1200 increases. Moreover, the first light control member 120 may preferably include three first bosses 1203 (see FIG. 1). These three first bosses 1203 each have a hollow circular cylindrical shape, and protrude forward from the front face of the first light blocker 1200. Note that, the first light blocker 1200, the first hollow cylindrical parts 1202 and the three first bosses 1203 may be preferably formed integrally of synthetic resin. Further, inner peripheral surfaces of the first light transmission channels 1201 and the first hollow cylindrical parts 1202 may preferably be subjected to surface texturing or provided with fine protrusions and recesses so as to diffuse light.

The second light control member 121 includes a second light blocker 1210 and second light transmission channels 1211 the number of which is equal to the number of first light transmission channels 1201 (that is, 22). The second light control member 121 may further preferably include second hollow cylindrical parts 1212 the number of which is equal to the number of second light transmission channels 1211 (that is, 22). The second light blocker 1210 may be preferably formed into a flat plate shape of material which does not transmit light emitted from LEDs 100 (e.g., opaque synthetic resin). The second light transmission channels 1211 each may preferably a circular hole penetrating the second light blocker 1210 in a thickness direction of the second light blocker 1210 (see FIG. 1 and FIG. 5). The second hollow cylindrical parts 1212 may preferably protrude rearward from peripheries of the second light transmission channels 1211 of a rear face of the second light blocker 1210 (see FIG. 5). Further, the second hollow cylindrical parts 1212 each may preferably have a circular tube shape, and have its diameter which becomes gradually smaller toward its rear end (see FIG. 5). In other words, each of the second hollow cylindrical parts 1212 has a diameter which becomes smaller as a distance from the second light blocker 1210 increases. Moreover, the second light control member 121 may preferably include three second bosses 1213 (see FIG. 1). These three second bosses 1213 each have a half hollow circular cylindrical shape, and protrude rearward from the rear face of the second light blocker 1210. Note that, the second light blocker 1210, the second hollow cylindrical parts 1212 and the three second bosses 1213 may be preferably formed integrally of synthetic resin. Further, inner peripheral surfaces of the second light transmission channels 1211 and the second hollow cylindrical parts 1212 may preferably be subjected to surface texturing or provided with fine protrusions and recesses so as to diffuse light.

The supporting member 14 includes a base part 140 and pillars (in the illustrated example, five pillars) 141 (see FIG. 1). Note that, the base part 140 and the five pillars 141 may be formed as a single die-cast aluminum product. The base part 140 is formed into a rectangular plate shape. The base part 140 includes circular through holes 142 the number of which is equal to the number of first lenses 110 (that is, 22) (see FIG. 1). Further, the base part 140 includes four stepped parts 143 (see FIG. 1). These four stepped parts 143 are formed integrally with four corners of the base part 140 so as to be set back from the base part 140. Further, the base part 140 includes two bosses. One of the bosses protrudes rearward from an upper left corner of a rear face of the base part 140 and the other protrudes rearward from a rear face of a protrusion piece 145 with a rectangular plate shape. Note that, the protrusion piece 145 protrudes downward from a center of a lower end of the base part 140 in the left and right direction. These two bosses includes bolt insertion holes 144 penetrating therethrough in the forward and rearward direction. The five pillars 141 protrude forward from the four corners of the base part 140 and the almost center of the base part 140. These five pillars 141 each include at its end (front end) a female screw (screw hole) 1410 (see FIG. 1).

As shown in FIG. 2 to FIG. 5, the aforementioned LED module 10, first lens array 11, light control member 12 and second lens array 13 are screwed to the supporting member 14. The LED module 10 is supported on a rear side of the base part 140 of the supporting member 14. Two bolts 146 are inserted into the two bolt insertion holes 144 of the base part 140 from their front sides. These two bolts 146 are inserted into two holes 1011 provided to the printed wiring board 101, and are engaged with and tightened to nuts on a rear surface (a non-mounting surface) side of the printed wiring board 101. Accordingly, the printed wiring board 101 of the LED module 10 is screwed (or bolted) to the base part 140 using two sets of the bolt 146 and the nut (see FIG. 2). Note that, in a front view, each of the LEDs 100 of the LED module 10 is positioned in an almost center of a corresponding one of the through holes 142 of the base part 140.

The first lens array 11 is supported on a front side of the base part 140 of the supporting member 14. Note that, the first lenses 110 of the first lens array 11 are individually inserted into the through holes 142 of the base part 140 (see FIG. 5). Three screws are inserted into three holes 1130 provided to the first support 113 of the first lens array 11 (see FIG. 1). These three screws are engaged with and tightened to three female screws 1400 (see FIG. 1) provided to the base part 140. Thus, the first lens array 11 is screwed (or bolted) to the base part 140 using the three screws (see FIG. 3 to FIG. 5). Note that, in a front view, centers of the first lenses 110 almost overlap with centers of the resin parts 1000 of the LEDs 100.

The first light control member 120 is supported on the base part 140 of the supporting member 14 so as to be in front of the first lens array 11. Four screws are inserted into four holes provided to the first light blocker 1200 of the first light control member 120, individually. These four screws are inserted into four holes 1131 provided to the first support 113 of the first lens array 11, individually. Further, these four screws are engaged with and tightened to four female screws 1401 (see FIG. 1) provided to the base part 140, individually. Accordingly, the first light control member 120 is screwed or bolted to the base part 140 using the four screws with the first lens array 11 in-between (see FIG. 3 to FIG. 5). Note that, in a front view, centers of the first light transmission channels 1201 almost overlap with centers of the first lenses 110.

Figure 3:
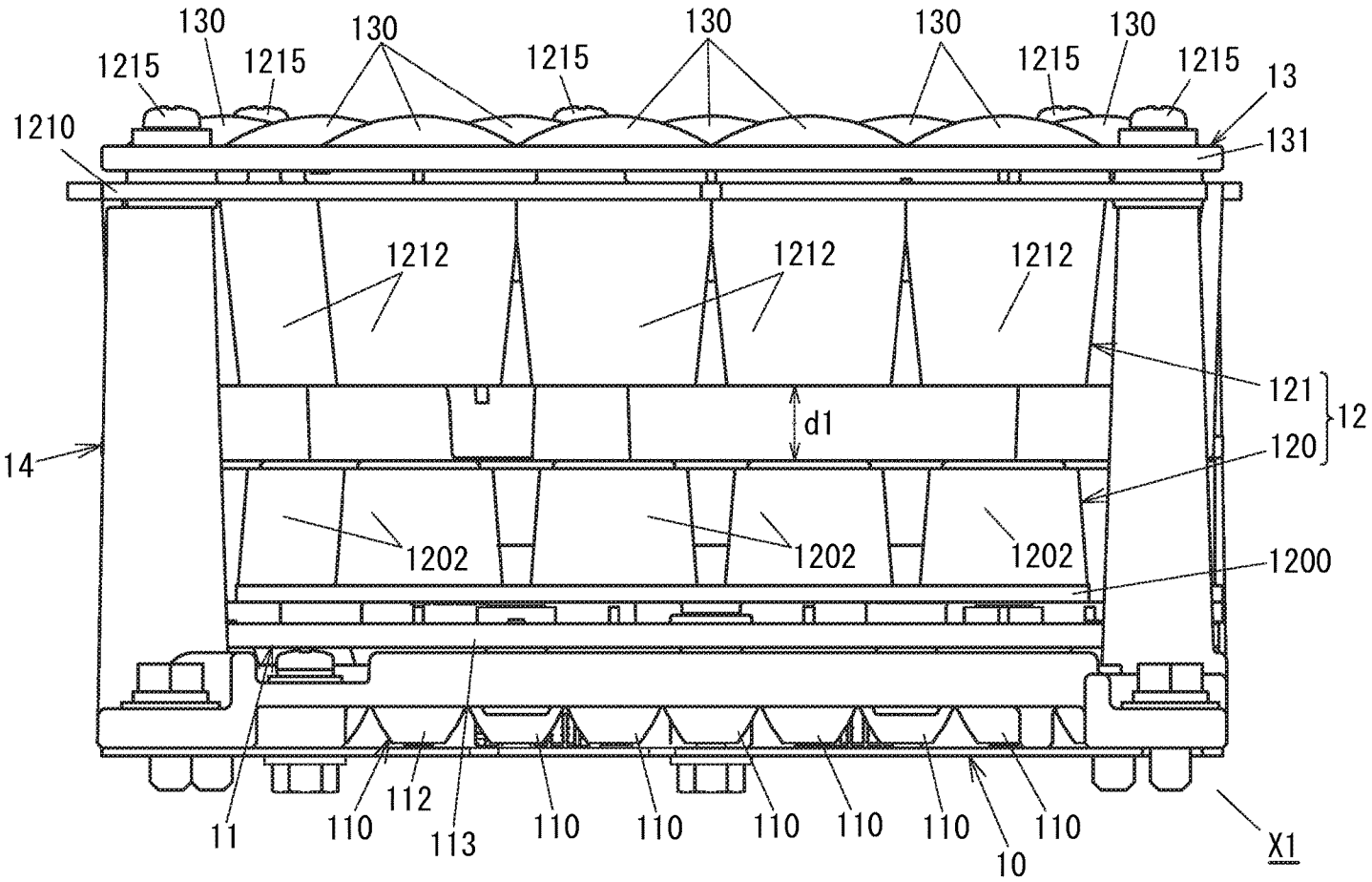
FIG. 3 is a plan view of the illuminating device of the above.
Figure 4:
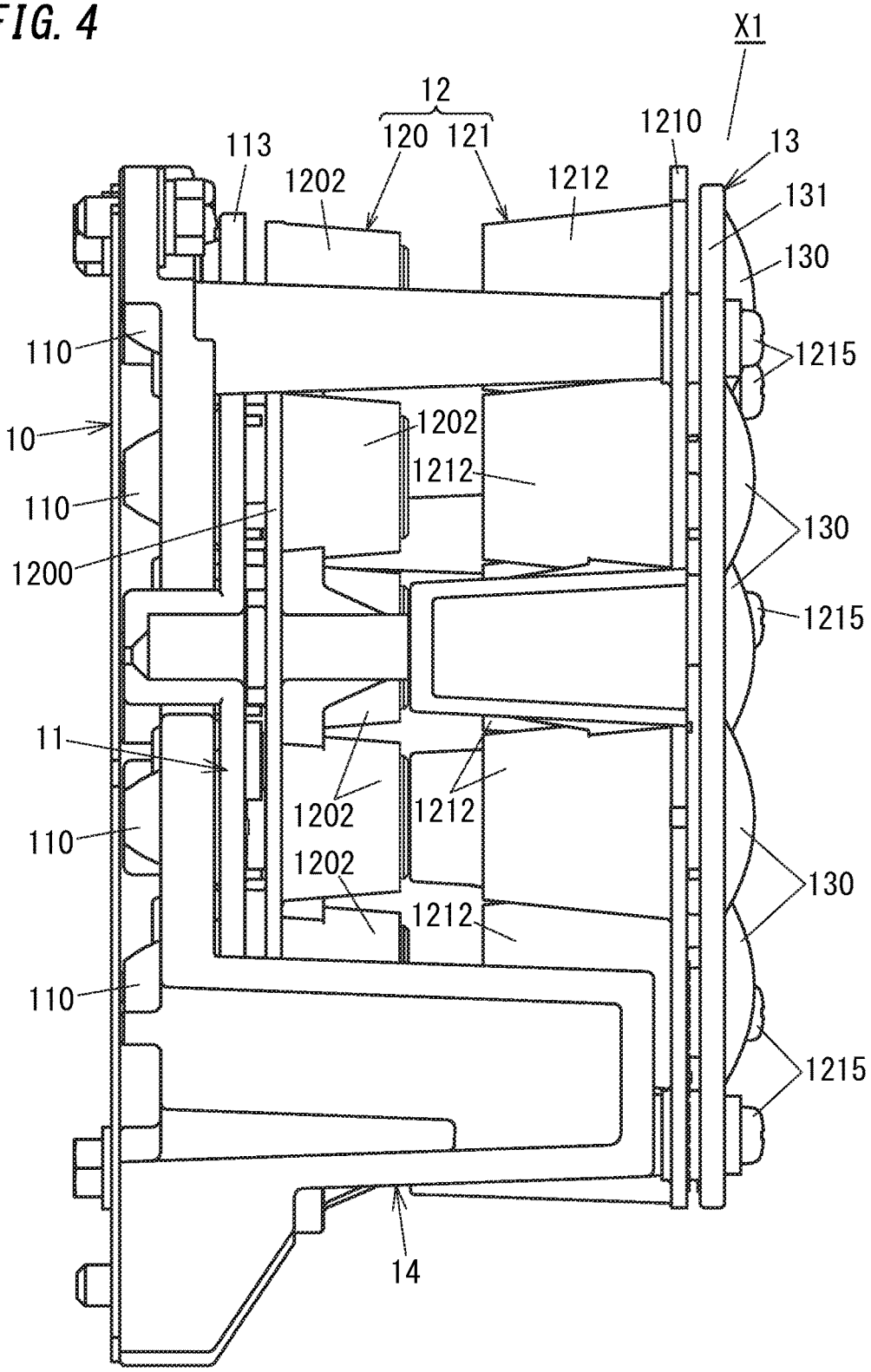
FIG. 4 is a left side view of the illuminating device of the above.
Figure 5:
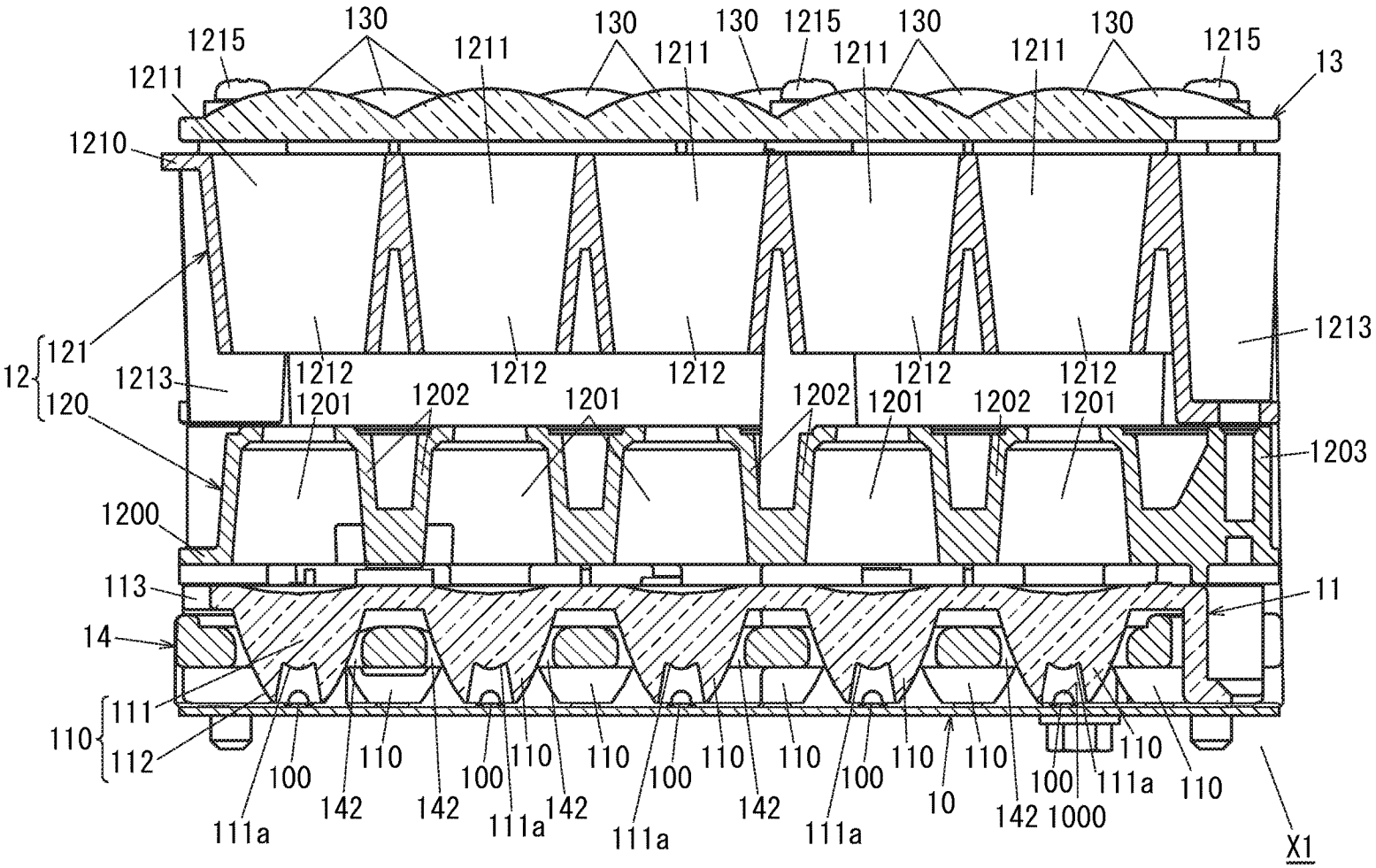
FIG. 5 is a section of the illuminating device of the above.

The second light control member 121 is supported on the five pillars 141 of the supporting member 14 and the three first bosses 1203 of the first light control member 120 so as to be in front of the first light control member 120 (see FIG. 3 to FIG. 5). The three second bosses 1213 of the second light control member 121 are bolted to the three first bosses 1203 of the first light control member 120. Further, five screws 1215 are individually inserted into five holes 1214 provided to the second light blockers 1210 of the second light control member 121. These five screws 1215 are individually inserted into the five holes 1214 provided to the second light blockers 1210. Further, these five screws 1215 are individually engaged with and tightened to the female screws 1410 provided to the ends of the five pillars 141. Note that, the pillars 141 protruding from a center of the base part 140 is inserted into both a hole 1132 provided to a center of the first support 113 of the first lens array 11 and a hole 1204 provided to a center of the first light blocker 1200 of the first light control member 120. Note that, in a front view, centers of the second light transmission channels 1211 almost overlap with centers of the first lenses 110.

The second lens array 13 is supported on the five pillars 141 of the supporting member 14 so as to be in front of the second light control member 121 (see FIG. 2 to FIG. 5). The five screws 1215 are individually inserted into five holes 132 (see FIG. 1) provided to four corners and a center of the second support 131 of the second lens array 13. Accordingly, the second lens array 13 is screwed (or bolted) to the five pillars 141 using the five screws 1215 together with the second light control member 121 (see FIG. 2). Note that, in a front view, centers of the second lenses 130 almost overlap with centers of the first lenses 110.

Figure 6:
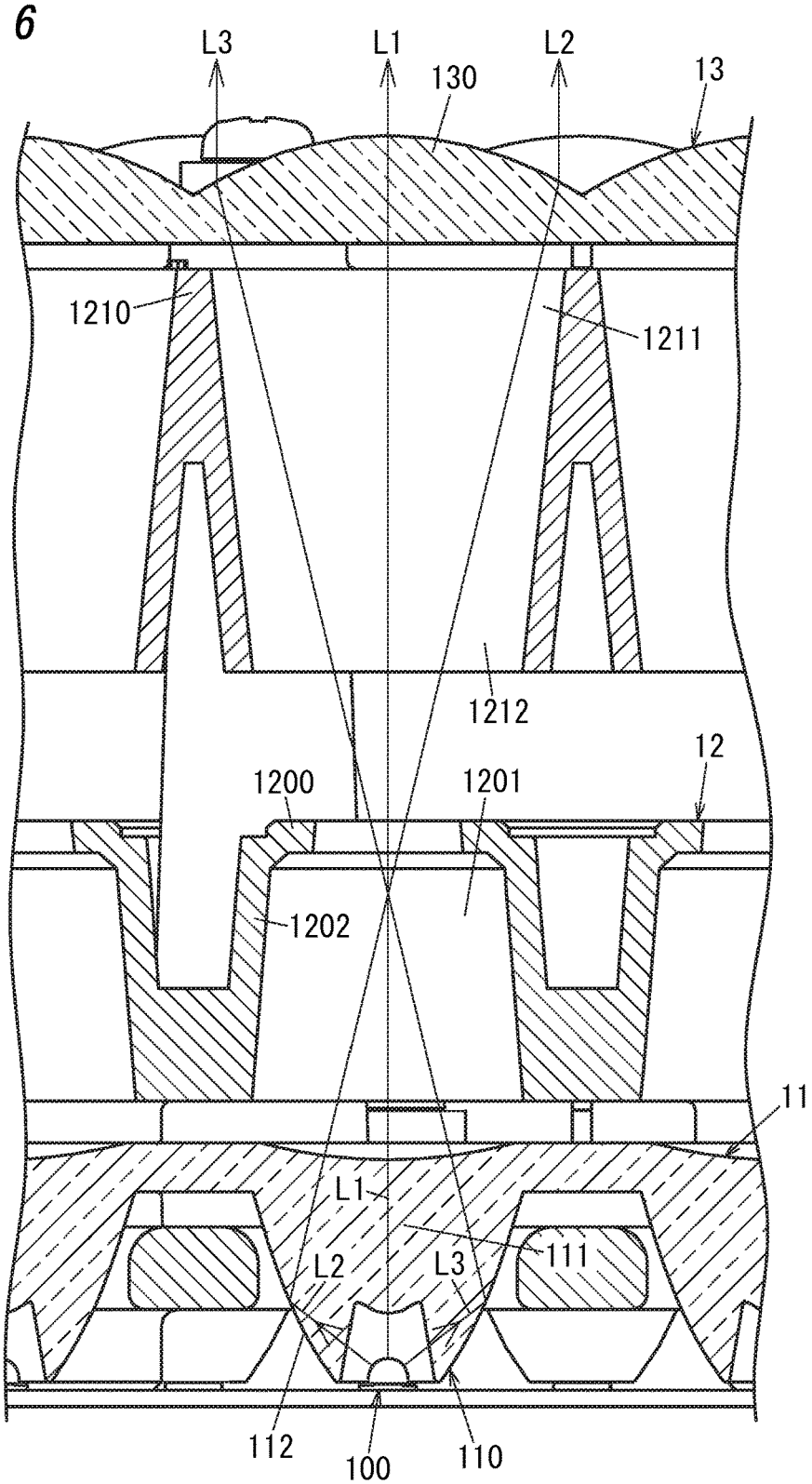
FIG. 6 is a section of a primary part of the illuminating device of the above.

As shown in FIG. 6, with regard to rays L1 to L3 of emitted light emitted from the LED 100, the ray L1 of the emitted light strikes the light concentrator 111 of the first lens 110 and is concentrated by the light concentrator 111 and then emerges outside from the first lens 110. With regard to the rays L1 to L3 of the emitted light emitted from the LED 100, the rays L2 and L3 of the emitted light are not concentrated, but reflected by the reflector 112 (in a manner of total internal reflection) and then emerge outside from the first lens 110. Inside the first light transmission channel 1201, these rays L2 and L3 of the emitted light (reflected light) cross a ray of light (concentrated light) which emerges outside the first lens 110 after concentrated by the light concentrator 111 (see FIG. 6). Note that, rays of the reflected light which emerge outside from the first lens 110 after reflected by the reflector 112 but are not transmitted by (do not pass through) the first light transmission channel 1201 and the second light transmission channel 1211 will be blocked by any of the first light blocker 1200, the first hollow cylindrical part 1202, the second light blocker 1210, and the second hollow cylindrical part 1212. In contrast, rays of light (the concentrated light and the reflected light) which are transmitted by (pass through) the first light transmission channel 1201 and the second light transmission channel 1211 strike the second lens 130. The rays of light (the concentrated light and the reflected light) which strike the second lens 130 are refracted when emerging outside from the second lens 130 (see FIG. 6). Thus, unnecessary rays of light (peripheral light) are excluded from rays of light which emerge outside from the second lens 130 by the light control member 12, and therefore ununiformity of luminance at peripheries (edges) can be suppressed. Moreover, distribution of rays of light emitted from the second lens 130 is controlled by the second lens 130.

Accordingly, rays of emitted light which are not concentrated by the light concentrator 111 of the first lens 110 are reflected by the reflector 112, and therefore the illuminating device X1 can improve the usage efficiency of light emitted from the LED 100. Additionally, the illuminating device X1 can block unnecessary rays of the reflected light reflected by the reflector 112, by use of the first light blocker 1200 and the second light blocker 1210. Therefore, the illuminating device X1 can improve the uniformity ratio (degree of uniformity of illuminance on an illuminated plane (the uniformity ratio of illuminance)) of light (illumination light) emerging outside from the second lenses 130. In addition, the illuminating device X1 includes two light control members (the first light control member 120 and the second light control member 121) and therefore can block, by use of the two light control members (the first light control member 120 and the second light control member 121), unnecessary rays of light which cannot be blocked by one light control member (the first light control member 120). As a result, the illuminating device X1 can further improve the uniformity ratio of illumination light compared with a case where the illuminating device X1 includes a single light control member. Further, the illuminating device X1 can block rays of reflected light which are transmitted by the first light transmission channel 1201 but travel toward other second light transmission channels 1211 adjacent to the corresponding second light transmission channel 1211, by use of the first hollow cylindrical part 1202 and the second hollow cylindrical part 1212. Consequently, the illuminating device X1 can further improve the uniformity ratio of illumination light (the uniformity ratio of illuminance) compared with a case where the illuminating device X1 does not include the first hollow cylindrical parts 1202 and the second hollow cylindrical parts 1212. Moreover, the illuminating device X1 can suppress unnecessary light from striking the second light transmission channels 1211, and therefore can suppress halation.

As described above, the illuminating device X1 includes the LEDs 100, the first lens array 11, the second lens array 13, and the light control member 12. The first lens array 11 includes the first lenses 110 individually corresponding to the LEDs 100. The light control member 12 includes the light transmission channels (the first light transmission channels 1201) individually corresponding to the first lenses 110, and the light blocker (the first light blocker 1200) surrounding the first light transmission channels 1201. The second lens array 13 includes the second lenses 130 individually corresponding to the first light transmission channels 1201. Each of the first lenses 110 includes the light concentrator 111 for producing concentrated light by concentrating a part of light emitted from a corresponding LED 100 of the LEDs 100. Each of the first lenses 110 includes the reflector 112 surrounds the light concentrator 111 to produce reflected light by reflecting another part of the light emitted from the corresponding LED 100 in a direction across the concentrated light. Each of the first lenses 110 is configured to output illumination light including the concentrated light and the reflected light. Each of the light transmission channels (the first light transmission channels 1201) is for transmitting the illumination light output from a corresponding first lens 110 of the first lenses 110. The light blocker (the first light blocker 1200) is for preventing transmission of the illumination light emitted from each of the first lenses 110. Each of the second lenses 130 is for refracting the illumination light transmitted by a corresponding light transmission channel (the first light transmission channel 1201) of the light transmission channels (the first light transmission channels 1201).

The illuminating device X1 is configured as described above, and therefore rays of emitted light which are not concentrated by the light concentrators 111 of the first lenses 110 are reflected by the reflectors 112 and thus the usage efficiency of light emitted from the LEDs 100 can be improved. Further, unnecessary rays of reflected light reflected by the reflectors 112 can be blocked by the first light blockers 1200 and the second light blockers 1210, and the illuminating device X1 can improve the uniformity ratio of illumination light emerging outside from the second lenses 130.

Preferably, in the illuminating device X1, each of the light transmission channels may include the first light transmission channels 1201 and the second light transmission channels 1211. The first light transmission channel 1201 may preferably face the first lens array 11 to transmit the illumination light output from a corresponding first lens 110 of the first lenses 110. The second light transmission channels 1211 may preferably face the second lens array 13 to transmit the illumination light transmitted by the first light transmission channel 1201. The light blocker may preferably include the first light blocker 1200 which faces the first lens array 11 and surrounds the first light transmission channel 1201 of each of the light transmission channels, and the second light blocker 1210 which faces the second lens array 13 and surrounds the second light transmission channel 1211 of each of the light transmission channels.

When the illuminating device X1 configured as above, it can block, by use of the two light blockers (the first light blocker 1200 and the second light blockers 1210), unnecessary rays of light which cannot be blocked by one light blocking member. As a result, the illuminating device X1 can further improve the uniformity ratio of illumination light compared with a case where the illuminating device X1 includes a single light blocking member.

Additionally, in the illuminating device X1, the light control member (the first light control member 120) may preferably include the first hollow cylindrical parts 1202 individually surrounding the first light transmission channels 1201. The light control member (the second light control member 121) may preferably include the second hollow cylindrical parts 1212 individually surrounding the second light transmission channels 1211. The first hollow cylindrical parts 1202 may preferably protrude from the first light blocker 1200 toward the second light control member 121. Moreover, the second hollow cylindrical parts 1212 may preferably protrude from the second light blockers 1210 toward the first light control member 120.

When the illuminating device X1 is configured as above, it can block rays of reflected light which are transmitted by the first light transmission channel 1201 but travel toward other second light transmission channels 1211 adjacent to the corresponding second light transmission channel 1211, by use of the first hollow cylindrical part 1202 and the second hollow cylindrical part 1212. Consequently, the illuminating device X1 can further improve the uniformity ratio of illumination light compared with a case where the illuminating device X1 does not include the first hollow cylindrical parts 1202 and the second hollow cylindrical parts 1212.

Figure 7:
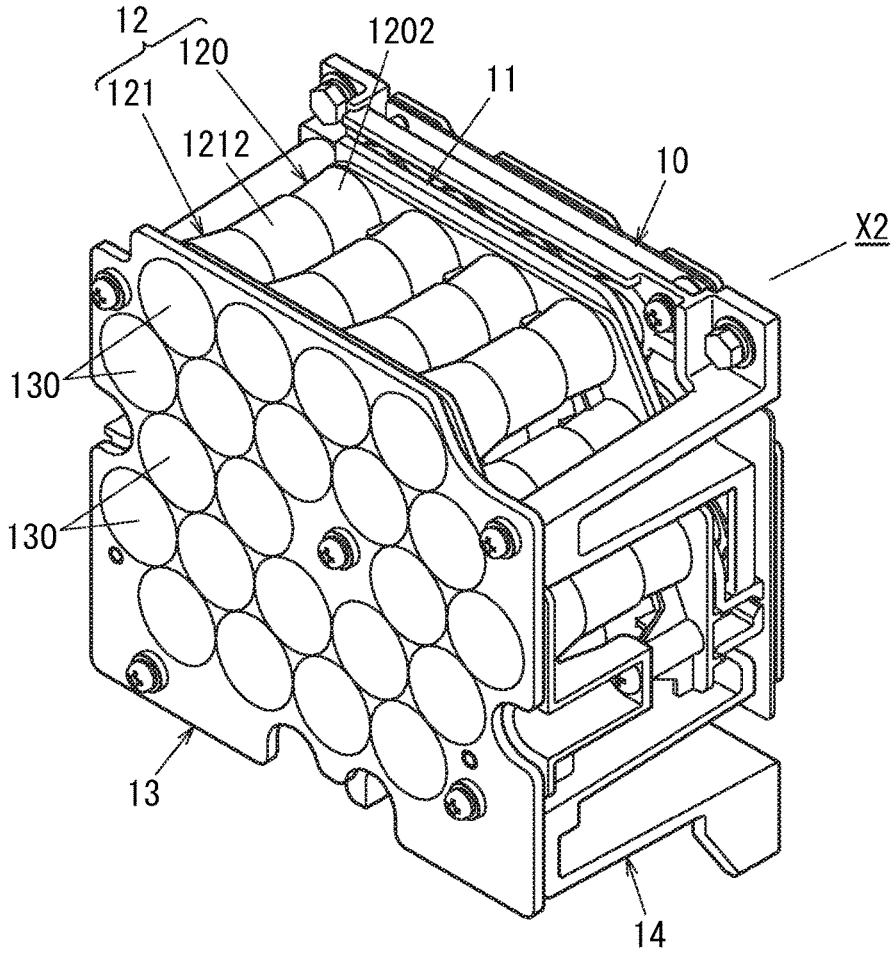
FIG. 7 is a perspective view of a modification of the illuminating device of the above.
Figure 8:
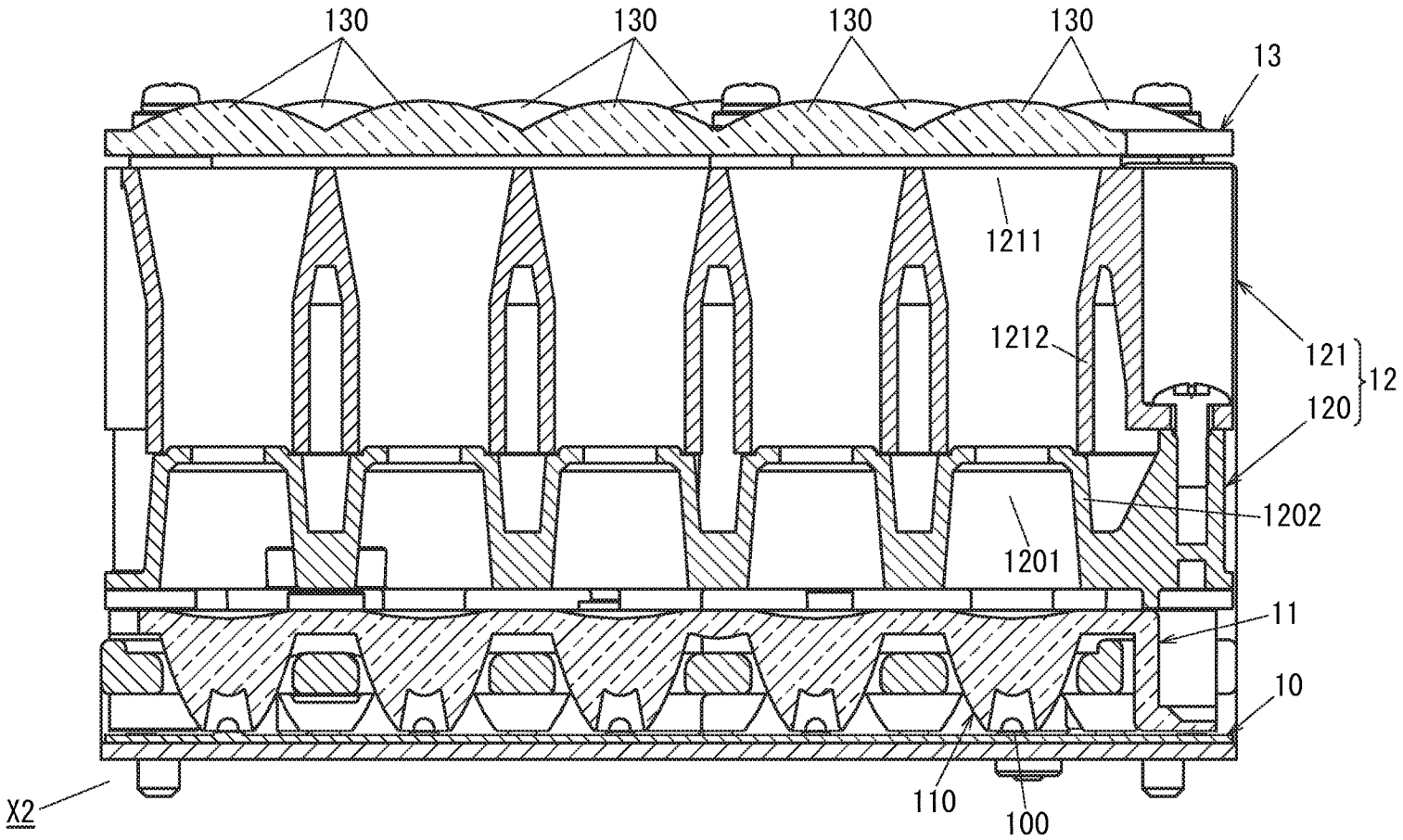
FIG. 8 is a section of the modification of the illuminating device of the above.

Note that, the second hollow cylindrical parts 1212 are individually separated, by a predetermined distance d1, from the first hollow cylindrical parts 1202 in the forward and rearward direction (see FIG. 3). However, as shown in FIG. 7 and FIG. 8, the second hollow cylindrical parts 1212 may not be separated from and may be in contact with the first hollow cylindrical parts 1202. In other words, the first hollow cylindrical parts 1202 and the second hollow cylindrical parts 1212 face each other and are in contact. FIG. 7 and FIG. 8 show an illuminating device X2 according to a modification of Embodiment 1, in which the first hollow cylindrical parts 1202 have front ends in contact with rear end of the second hollow cylindrical parts 1212 individually. The illuminating device X2 according to the modification can block rays of reflected light which are transmitted by the first light transmission channel 1201 but travel toward other second light transmission channels 1211 adjacent to the corresponding second light transmission channel 1211, by use of the first hollow cylindrical part 1202 and the second hollow cylindrical part 1212, in a similar manner to the illuminating device X1 according to Embodiment 1.

However, when the illuminating device X2 according to the modification is used outdoor, sunlight may be concentrated by the second lenses 130 and thus may cause great increases in temperatures at the front end parts of the first hollow cylindrical parts 1202 and the rear end parts of the second hollow cylindrical parts 1212. When the first hollow cylindrical parts 1202 and the second hollow cylindrical parts 1212 are made of thermoplastic resin (e.g., polybutylene terephthalate resin), temperature increase may cause deformation of the first hollow cylindrical parts 1202 and the second hollow cylindrical parts 1212. In particular, to suppress reflection of light, the second hollow cylindrical parts 1212 are colored with a color which absorbs light (sunlight) well (e.g., black). Hence, temperature may be considered to easily increase.

To address this problem, the second hollow cylindrical parts 1212 are individually separated from the first hollow cylindrical parts 1202 by the predetermined distance d1, and thereby the illuminating device X1 according to Embodiment 1 can suppress increases in temperatures of the rear end parts of the second hollow cylindrical parts 1212. Additionally, in the illuminating device X1 according to Embodiment 1, the first light control member 120 including the first hollow cylindrical parts 1202 may preferably be colored with a color (e.g., white) which absorbs less sunlight than black. When the first hollow cylindrical parts 1202 have their surfaces whited, the illuminating device X1 can suppress increases in temperatures of the front end parts of the first hollow cylindrical parts 1202. Note that, the first light control member 120 may be made of synthetic resin which has low transmissivity and high reflectivity for sunlight.

As described above, in the illuminating device X1, the first hollow cylindrical parts 1202 and the second hollow cylindrical parts 1212 may preferably face each other and be separated by the predetermined distance d1.

When the illuminating device X1 is configured as above, it can suppress an increase in temperature of the second hollow cylindrical parts 1212 even if sunlight enters the illuminating device X1 through the second lenses 130.

Further, in the illuminating device X1, each of the first hollow cylindrical parts 1202 may have a surface having a color which absorbs less sunlight than black.

When the illuminating device X1 is configured as above, it can suppress an increase in temperature of the first hollow cylindrical parts 1202 even if sunlight enters the illuminating device X1 through the second lenses 130.

Note that, the first light transmission channels 1201 and the second light transmission channels 1211 are not necessarily circular holes. At least one of the first light transmission channels 1201 and the second light transmission channels 1211 may be formed into a shape other than a circular shape, such as a semicircular shape, a polygonal shape, and a star shape. In other words, at least one of the first light transmission channel 1201 and the second light transmission channel 1211 of each of the light transmission channels includes a non-circular through-hole. For example, when the first light transmission channels 1201 are formed into a semicircular shape, the shape of the illuminating light (which means a shape of an area illuminated by the illuminating light) emitted through the second lenses 130 also becomes a semicircular shape.

As described above, in the illuminating device X1, at least ones of the first light transmission channels 1201 and the second light transmission channels 1211 may preferably be formed in a shape configured to partially block the illumination light.

When the illuminating device X1 is configured as above, a shape of the illuminating light emitted through the second lenses 130 can be easily changed by changing in shapes of the first light transmission channels 1201 and the second light transmission channels 1211.

Figure 9B:
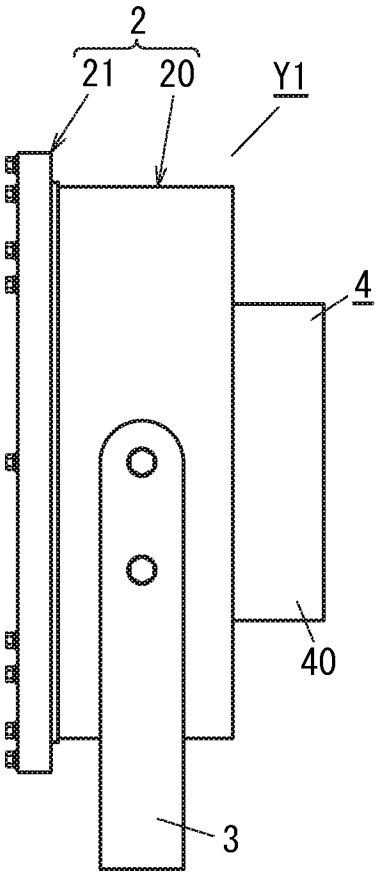
FIG. 9B is a side view of the illuminating fixture including the illuminating device of the above.
Figure 9A:
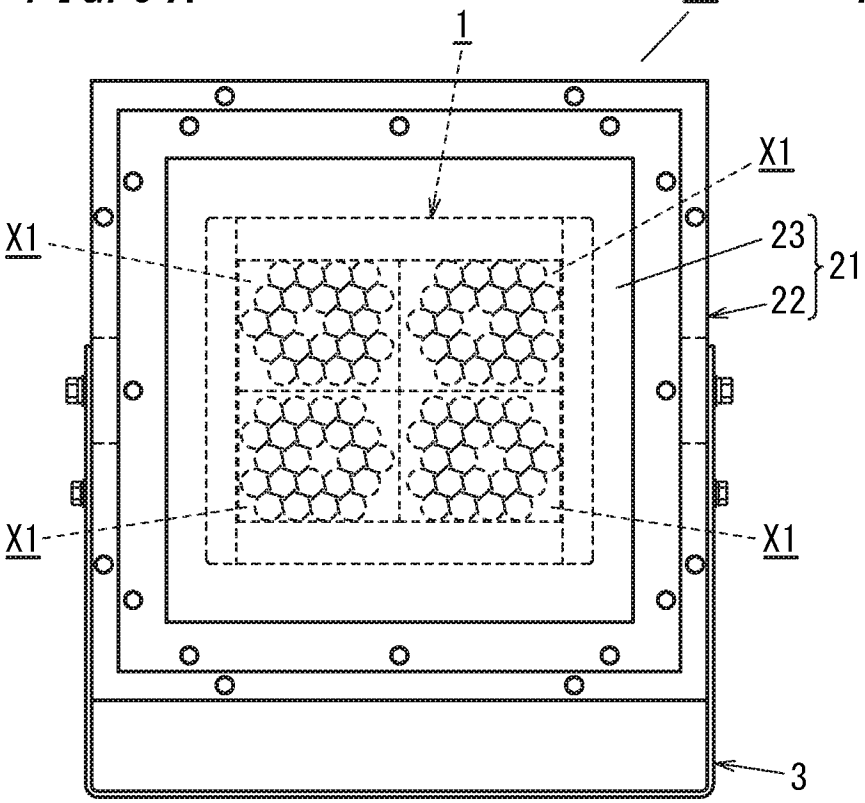
FIG. 9A is a front view of an illuminating fixture including the illuminating device of the above.

Note that, as shown in FIG. 9A and FIG. 9B, the illuminating device X1 may be preferably used as a light source of an illuminating fixture (projector) Y1. The illuminating fixture Y1 may preferably include a fixture body 2, an arm 3, and a power supply unit 4. The fixture body 2 may include a casing 20 and a cover 21. The casing 20 is made of a metal plate such as a stainless steel plate, and is formed into a box shape with an open front face. The cover 21 includes a frame 22 and a panel 23. The frame 22 is made of a metal plate such as a stainless steel plate, and is formed into a rectangular frame shape. The panel 23 is made of transparent or translucent synthetic resin (e.g., acrylic resin and polycarbonate resin), and is formed into a rectangular flat plate shape. The panel 23 is supported by the frame 22. The cover 21 is attached to the casing 20 so as to cover the front face of the casing 20. The arm 3 is made of a metal plate such as a stainless steel plate, and is formed into a U-shape. The arm 3 has opposite ends screwed to opposite side walls of the casing 20. Thus, the casing 20 (the fixture body 2) is supported by the arm 3 in a rotatable manner. The power supply unit 4 includes the case 40 of metal, and a power supply accommodated in the case 40. For example, the power supply converts AC power supplied from an AC power system into DC power. The case 40 is attached to a rear face of the casing 20 (see FIG. 9B).

Figure 10:
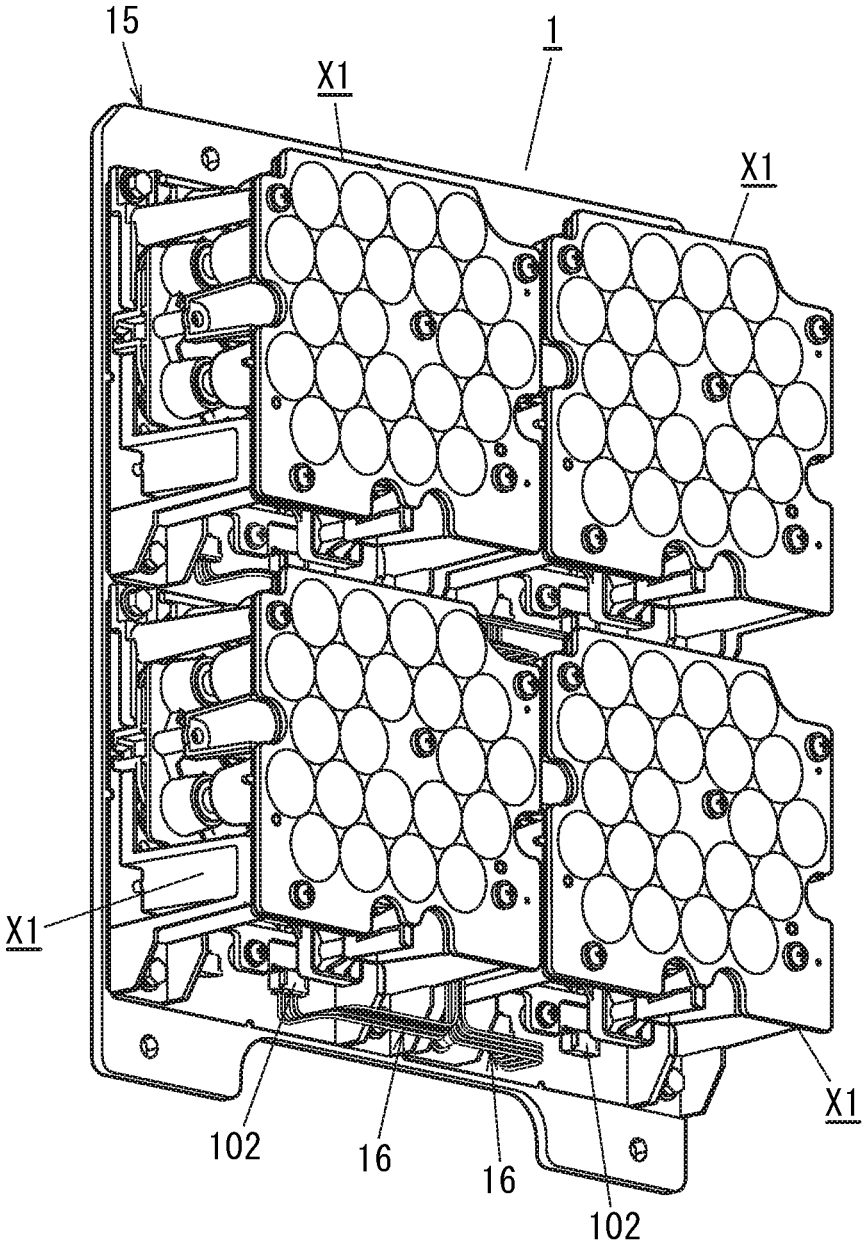
FIG. 10 is a perspective view of an illuminating unit in the above illuminating fixture.

As shown in FIG. 9A, the casing 20 accommodates an illuminating unit 1. As shown in FIG. 10, the illuminating unit 1 includes the four illuminating devices X1, an attaching plate 15, and power cables 16. The attaching plate 15 is made of a metal plate such as an aluminum plate and zinc steel plate, and is formed into a rectangular flat plate. The four illuminating devices X1 are attached to a front face of the attaching plate 15 so as to be arranged in a two-by-two array in the upward and downward direction and the left and right direction. In each of the four illuminating devices X1, the four stepped parts 143 of the supporting member 14 are screwed (or bolted) to the attaching plate 15. The power cable 16 includes power lines (in the illustrated example, four power lines) and a plug connector provided to ends of these four power lines. The power cable 16 is connected to the receptacle connector 102 of the LED module 10. Thus, these four illuminating devices X1 are supplied with DC power from the power supply unit 4 through the power cables 16.

Embodiment 2

Figure 11:
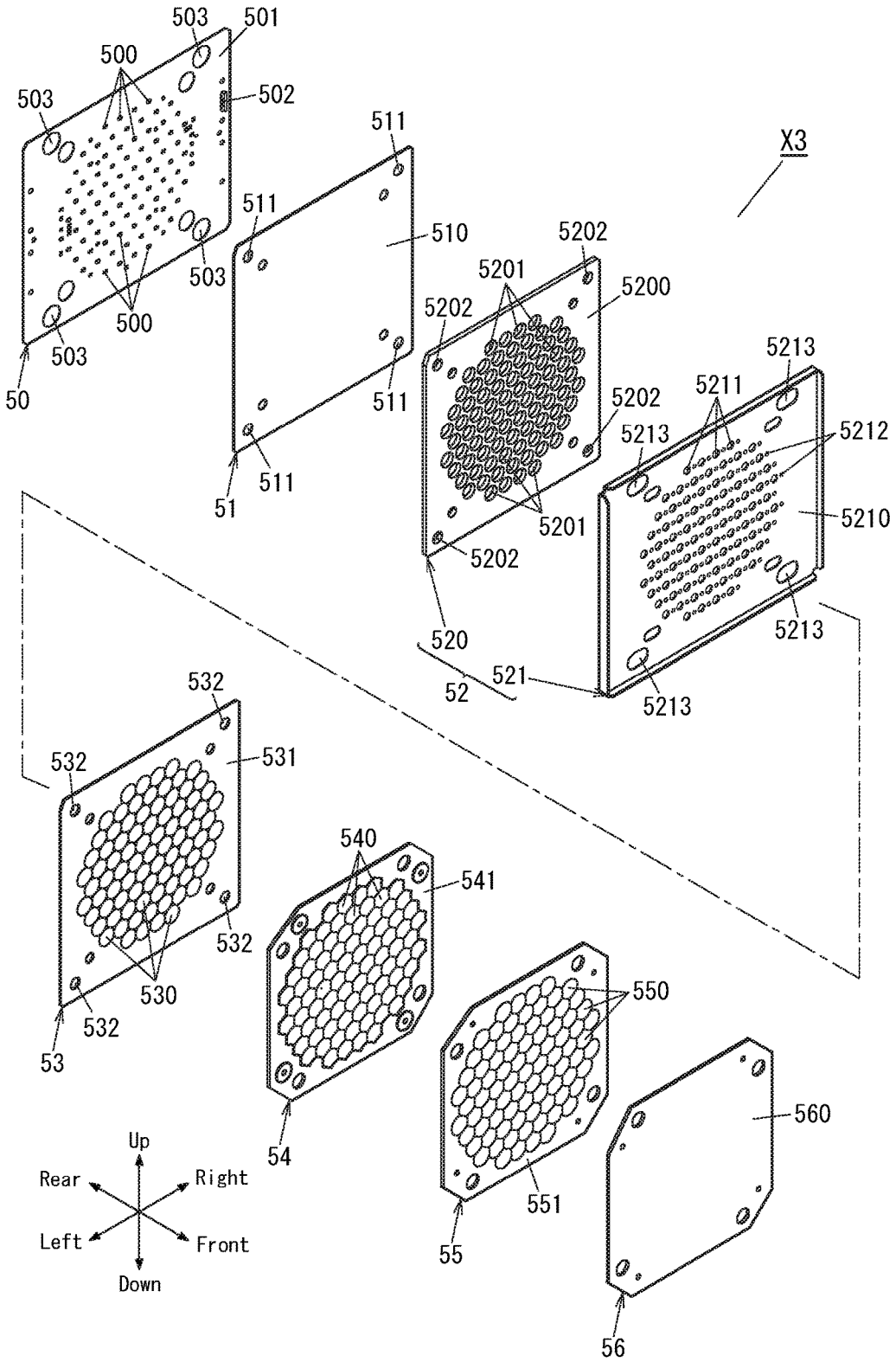
FIG. 11 is an exploded perspective view of an illuminating device according to Embodiment 2 of the present disclosure.

As shown in FIG. 11, an illuminating device X3 according to Embodiment 2 includes an LED module 50, a first lens array 51, a light control member 52, and a second lens array 53. Additionally, the illuminating device X3 may preferably include a first movable lens array 54, a second movable lens array 55, and a third movable lens array 56. Note that, in the following description, unless otherwise noted, the forward, rearward, left, right, upward and downward directions of the illuminating device X3 correspond to those shown in FIG. 11 and FIG. 12.

The LED module 50 includes a printed wiring board 501 with a rectangular plate shape, and LEDs (in the illustrated example, eighty-five LEDs) 500 (see FIG. 11). Note that, the number of LEDs 500 is not limited to 85. There are circular holes 503 formed individually in four corners of the printed wiring board 501. Note that, the LEDs 500 have the same configuration as the LEDs 100 in the illuminating device X1 according to Embodiment 1. These LEDs 500 are soldered to pads formed on a front face of the printed wiring board 501 and thereby mounted on the front face (hereinafter referred to as "mounting surface") of the printed wiring board 501. Further, it is preferable that there be a receptacle connector 502 mounted on the mounting surface of the printed wiring board 501 (see FIG. 11). The receptacle connector 502 is electrically connected to the LEDs 500 through printed wires (conductors) formed on the mounting surface of the printed wiring board 501.

The first lens array 51 includes first lenses the number of which is equal to the number of LEDs 500, and a first support 510 (see FIG. 11). Note that, these first lenses have the same configuration as the first lenses 110 in the illuminating device X1 according to Embodiment 1. The first support 510 supports the first lenses. The first support 510 is formed into an almost rectangular flat plate shape. The first lenses and the first support 510 may be formed integrally of transparent synthetic resin such as acrylic resin. Note that, there are circular holes 511 individually formed in four corners of the first support 510.

The second lens array 53 includes second lenses 530 the number of which is equal to the number of LEDs 500, and a second support 531 (see FIG. 11). The second support 531 supports the second lenses 530. The second support 531 is formed into an almost rectangular flat plate shape. Each of the second lenses 530 may preferably be a biconvex lens. The second lenses 530 and the second support 531 may be formed integrally of transparent synthetic resin such as acrylic resin. Note that, there are circular holes 532 individually formed in four corners of the second support 531.

The light control member 52 may preferably include at least a first light control member 520 and a second light control member 521 (see FIG. 11). The first light control member 520 includes a first light blocker 5200 and first light transmission channels 5201 the number of which is equal to the number of first lenses (that is, 85). The first light blocker 5200 may be preferably formed into a flat plate shape of material which does not transmit light emitted from LEDs 500 (e.g., opaque synthetic resin). The first light transmission channels 5201 each may preferably a circular hole penetrating the first light blocker 5200 in a thickness direction of the first light blocker 5200 (see FIG. 11). Note that, there are circular holes 5202 individually formed in four corners of the first light blocker 5200.

The second light control member 521 includes a second light blocker 5210 and second light transmission channels 5211 and third light transmission channels 5212 the numbers of which each are equal to the number of first light transmission channels 5201. The second light blocker 5210 may be preferably formed into a flat plate shape of material which does not transmit light emitted from LEDs 500 (e.g., opaque synthetic resin). The second light transmission channels 5211 each may preferably a circular hole penetrating the second light blocker 5210 in a thickness direction of the second light blocker 5210 (see FIG. 11). The third light transmission channels 5212 each may preferably a circular hole which penetrates the second light blocker 5210 in the thickness direction of the second light blocker 5210 and has an inner diameter smaller than each second light transmission channel 5211 (see FIG. 11). Note that, there are oval holes 5213 individually formed in four corners of the second light blocker 5210. These holes 5213 are formed to have long axes extending along the left and right direction.

The first movable lens array 54 includes first movable lenses 540 the number of which is equal to the number of LEDs 500, and a first movable support 541 (see FIG. 11). The first movable support 541 supports the first movable lenses 540. The first movable support 541 is formed into an almost hexagonal shape. These first movable lenses 540 each may preferably a concave lens. The first movable lenses 540 and the first movable support 541 may be formed integrally of transparent synthetic resin such as acrylic resin.

The second movable lens array 55 includes second movable lenses 550 the number of which is equal to the number of LEDs 500, and a second movable support 551 (see FIG. 11). The second movable support 551 supports the second movable lenses 550. The second movable support 551 is formed into an almost hexagonal shape. These second-movable lenses 550 each may preferably a biconvex lens. The second movable lenses 550 and the second movable support 551 may be formed integrally of transparent synthetic resin such as acrylic resin.

The third movable lens array 56 includes third movable lenses the number of which is equal to the number of LEDs 500, and a third movable support 560 (see FIG. 11). The third movable support 560 supports the third movable lenses. The third movable support 560 is formed into an almost hexagonal shape. These third movable lenses each may preferably a concave lens. The third movable lenses and the third movable support 560 may be formed integrally of transparent synthetic resin such as acrylic resin.

With regard to emitted light emitted from the LED 500, part of the emitted light striking the first lens is concentrated and then emerges outside from the first lens. With regard to the emitted light emitted from the LED 500, part of the emitted light which is not concentrated by the first lens, is reflected inside the first lens (in a manner of total internal reflection) and then emerges outside from the first lens. Inside the first light transmission channel 5201, the emitted light (reflected light) crosses light (concentrated light) which is concentrated. Note that, part of the reflected light which emerges outside from the first lens and is not transmitted by (does not pass through) the light transmission channel (the first light transmission channel 5201 and the second light transmission channel 5211 or the third light transmission channel 5212) of the light control member 52 will be blocked by the first light blocker 5200 or the second light blocker 5210. In contrast, part of light (the concentrated light and the reflected light) which is transmitted by (passes through) the first light transmission channel 5201 and the second light transmission channel 5211 (or the third light transmission channel 5212) strikes the second lens 530. The part of the light (the concentrated light and the reflected light) which strikes the second lens 530 is refracted when emerging outside from the second lens 530. Thus, unnecessary light (peripheral light) is excluded from light which emerges outside from the second lens 530 by the light control member 52, and therefore ununiformity of luminance at peripheries (edges) can be suppressed. Moreover, distribution of light emitted from the second lens 530 is controlled by the second lens 530.

Additionally, light emitted outside through the second lenses 530 is refracted each time transmitted by any of the first movable lenses 540, the second movable lenses 550, and the third movable lenses. The first movable lenses 540, the second movable lenses 550 and the third movable lenses are designed in order to allow increases in diameters of beams and aberration correction, of light emerging from the second lenses 530.

Additionally, it is preferable that the first movable lens array 54 and the second movable lens array 55 be movable by a moving mechanism 7 so as to increase and decrease distances (intervals) between the first movable lens array 54 and the second lens array 53 and between the second movable lens array 55 and the second lens array 53. Moreover, it is preferable that the third movable lens array 56 be movable by the moving mechanism 7 so as to increase and decrease distances (intervals) between the third movable lens array 56 and the first movable lens array 54 and between the third movable lens array 56 and the second movable lens array 55. Hereinafter, the moving mechanism 7 of the illuminating device X3 is described with reference to FIG. 12 to FIG. 14.

Figure 12:
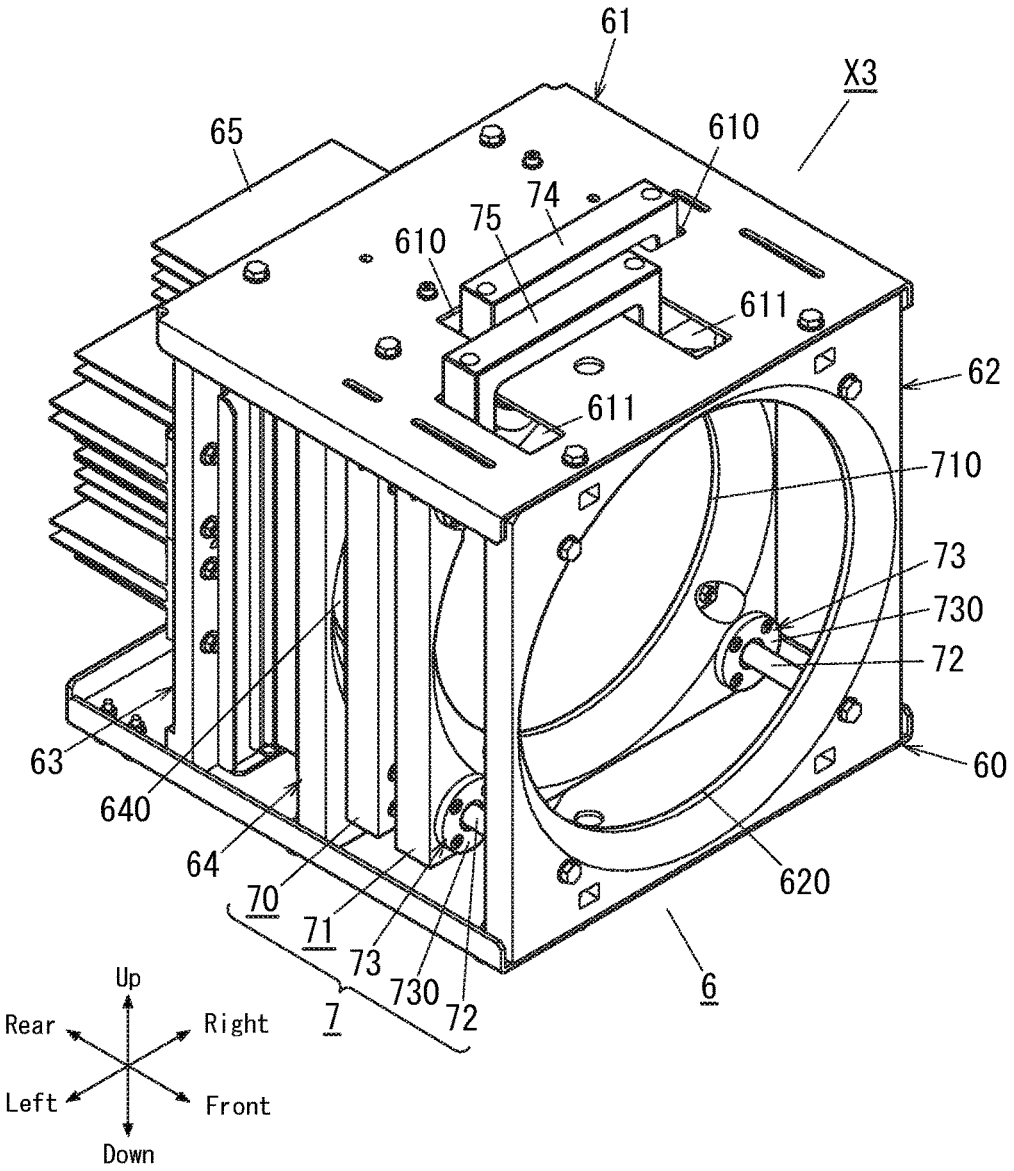
FIG. 12 is a perspective view of the illuminating device according to Embodiment 2 of the present disclosure.
Figure 13:
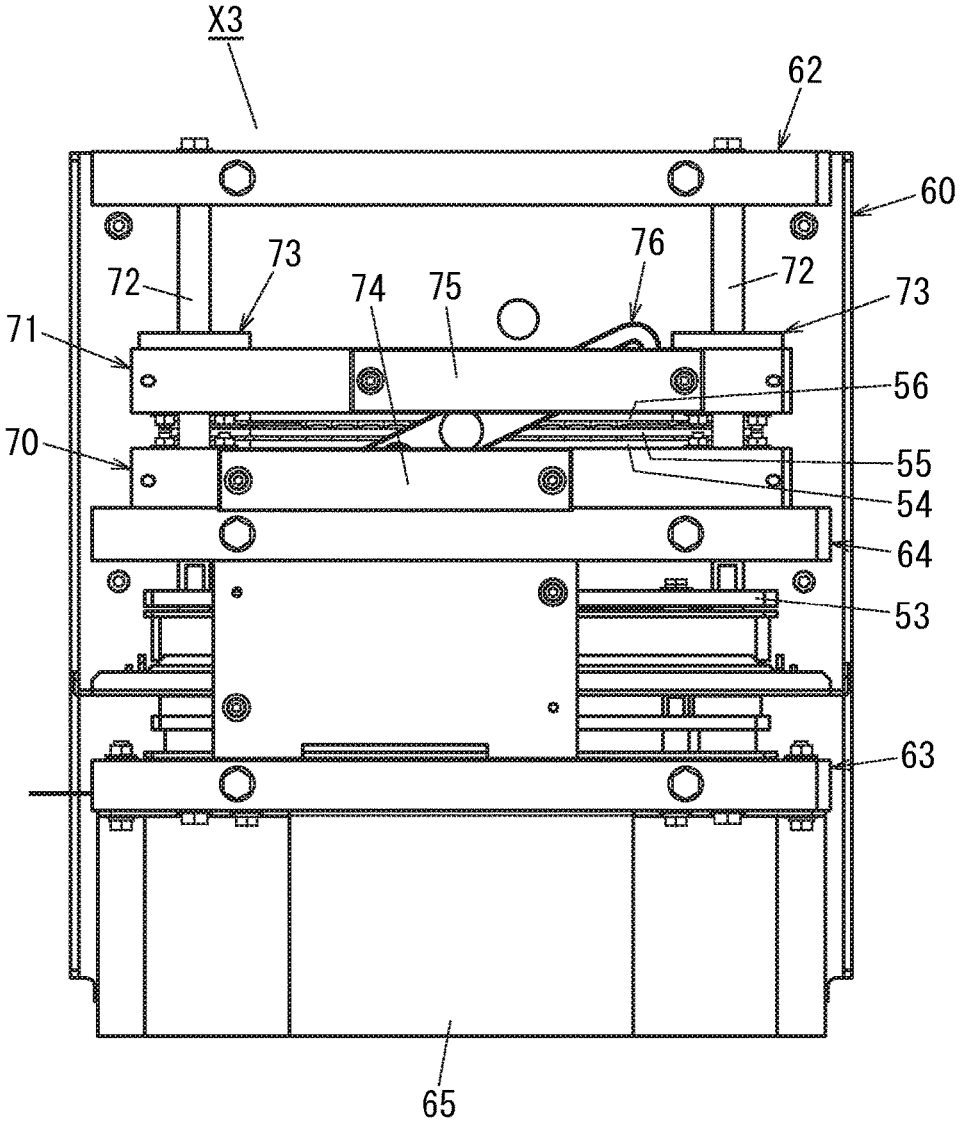
FIG. 13 is a plan view of the illuminating device according to Embodiment 2 of the present disclosure, wherein a top plate thereof is omitted.
Figure 14:
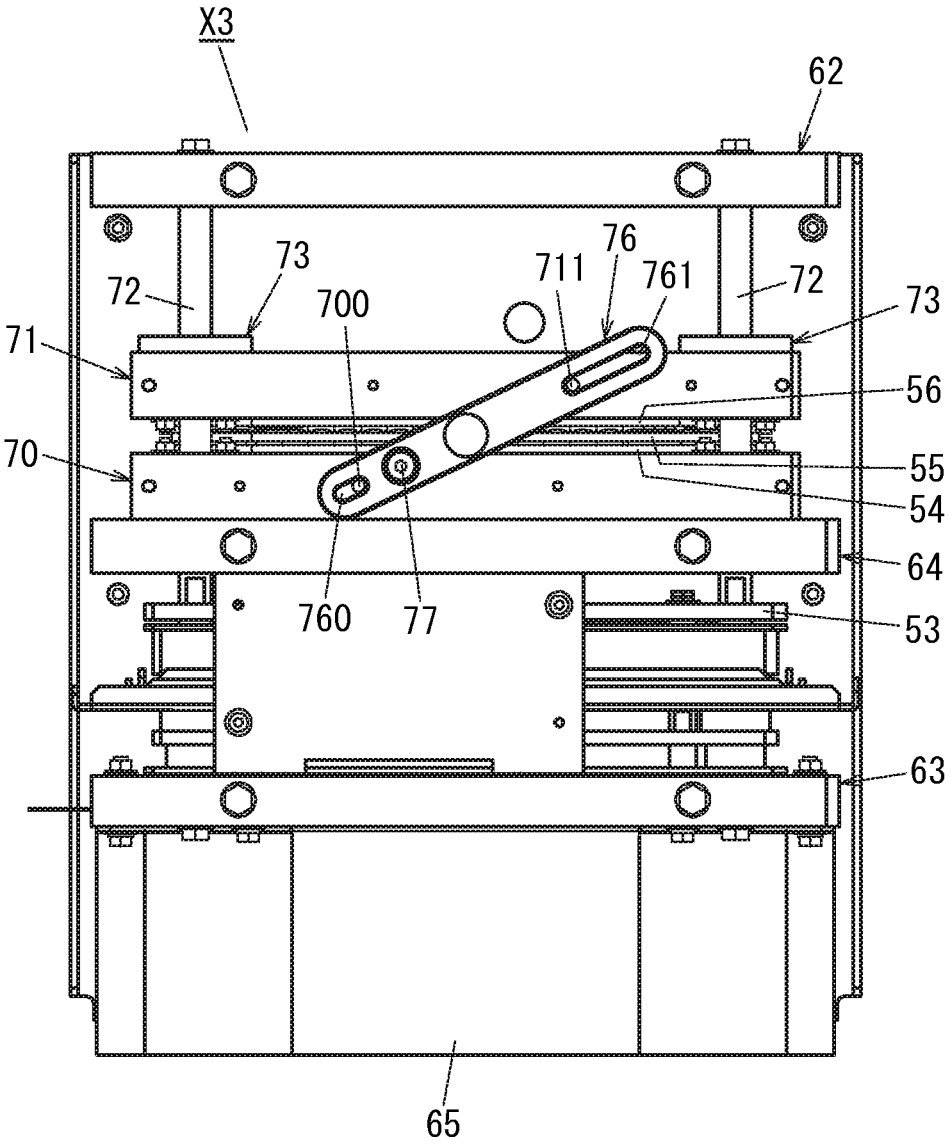
FIG. 14 is a plan view of the illuminating device according to Embodiment 2 of the present disclosure, wherein the top plate and a handle thereof are omitted.

The illuminating device X3 may preferably include a casing 6 together with the moving mechanism 7. As shown in FIG. 12 to FIG. 14, the casing 6 may preferably include a bottom plate 60, a top plate 61, a front plate 62, a rear plate 63 and an intermediate plate 64. The bottom plate 60 and the top plate 61 each are made of a rectangular metal plate. The top plate 61 is shorter in the forward and rearward direction than the bottom plate 60 (see FIG. 12). The front plate 62, the rear plate 63 and the intermediate plate 64 may be preferably formed into a rectangular plate shape of an aluminum die-casting product. The LED module 50 and a heat dissipation member 65 are screwed to a rear face of the rear plate 63. The rear plate 63 has holes the number of which is equal to the number of LEDs 500. These holes each penetrate the rear plate 63 in the forward and rearward direction. The first lenses of the first lens array 51 are individually inserted into the holes of the rear plate 63. The front plate 62 includes a circular window hole 620 which penetrates therethrough in a thickness direction (the forward and rearward direction). Likewise, the intermediate plate 64 includes a circular window hole 640 which penetrates therethrough in a thickness direction (the forward and rearward direction) (see FIG. 12). The front plate 62 is screwed to a front end of the bottom plate 60 and a front end of the top plate 61. Additionally, the rear plate 63 is screwed to the bottom plate 60 at part close to a rear end of the bottom plate 60, and also is screwed to a rear end of the top plate 61. Moreover, the intermediate plate 64 is screwed to intermediate parts of the bottom plate 60 and the top plate 61 in the forward and rearward direction.

The moving mechanism 7 may include a first holder 70, a second holder 71, four axles 72 and eight linear bearings 73. The first holder 70 is an aluminum die-casting product and is formed into a rectangular frame shape. Further, the first holder 70 includes a circular window hole penetrating therethrough in a thickness direction (the forward and rearward direction). The first movable lens array 54 and the second movable lens array 55 are screwed to a front face of the first holder 70. Note that, in a front view, the first movable lenses 540 of the first movable lens array 54 and the second movable lenses 550 of the second movable lens array 55 are positioned inside the window hole of the first holder 70. In addition, there is a handle 74 with an inverted U-shape attached to an upper face of the first holder 70. Note that, opposite ends of the handle 74 are individually inserted into a pair of grooves 610 provided to the top plate 61, as shown in FIG. 12.

The second holder 71 is an aluminum die-casting product and is formed into a rectangular frame shape. Further, the second holder 71 includes a circular window hole 710 penetrating therethrough in a thickness direction (the forward and rearward direction) (see FIG. 12). The third movable lens array 56 is screwed to a rear face of the second holder 71. Note that, in a front view, the third movable lenses of the third movable lens array 56 are positioned inside the window hole 710 of the second holder 71. In addition, there is a handle 75 with an inverted U-shape attached to an upper face of the second holder 71. Note that, opposite ends of the handle 75 are individually inserted into a pair of grooves 611 provided to the top plate 61, as shown in FIG. 12.

Four linear bearings 73 are screwed to four corners of the first holder 70 and other four linear bearings 73 are screwed to four corners of the second holder 71. The linear bearings 73 may include a bearer which has a hollow circular cylindrical shape and includes a rim (flange) 730 at one end, and rotors held by the bearer. The bearers of the linear bearings 73 are inserted into holes (holes penetrating in the forward and rearward direction) formed in the four corners of the first holder 70 and the four corners of the second holder 71. The rims 730 of the linear bearings 73 are screwed to the first holder 70 and the second holder 71.

The four axles 72 each are made of metal material such as stainless steel material, and formed into an elongated circular solid cylindrical shape. These four axles 72 have frond ends screwed to the four corners of the front plate 62, individually. These four axles 72 have rear ends screwed to the four corners of the rear plate 63, individually. Additionally, these four axles 72 are inserted into holes penetrating the four corners of the intermediate plate 64, individually. Accordingly, in a front view, these four axles 72 are positioned in four corners of the casing 6 so as to be parallel to the bottom plate 60 and the top plate 61 and be perpendicular to the intermediate plate 64 and the rear plate 63 (see FIG. 12 to FIG. 14). Note that, these four axles 72 are inserted into the holes 503 in the four corners of the LED module 50, the holes 511 in the four corners of the first lens array 51, the holes 5202 and the holes 5213 each in the four corners of the light control member 52, and the holes 532 in the four corners of the second lens array 53, individually.

Further, these four axles 72 are engaged to the four linear bearings 73 attached to the first holder 70 and also engaged to the other four linear bearings 73 attached to the second holder 71 (see FIG. 12). Accordingly, the first holder 70 and the second holder 71 are placed in a space between the front plate 62 and the intermediate plate 64 so that the linear bearings 73 allow the first holder 70 and the second holder 71 to move in the forward and rearward direction along the four axles 72.

The first holder 70 and the second holder 71 are interconnected by two interconnecting members 76. As shown in FIG. 14, the two interconnecting members 76 each are formed into an elongated bar shape. Each of the two interconnecting members 76 includes a first guiding hole 760 and a second guiding hole 761. The first guiding hole 760 is formed into an oval shape penetrating a rear end part of the interconnecting members 76 in the upward and downward direction. The second guiding hole 761 is formed into an oval shape penetrating a front end part of the interconnecting members 76 in the upward and downward direction. Note that, the second guiding hole 761 has a dimension in a long axis which is longer than a dimension in a long axis of the first guiding hole 760 (see FIG. 14). A first one of the interconnecting members 76 is attached to the top plate 61 by a bolt 77 and a nut so as to be rotatable around the bolt 77. A second one of the interconnecting members 76 is attached to the bottom plate 60 by a bolt and a nut so as to be rotatable around the bolt. Further, there is a first pin 700 which protrudes from the upper face of the first holder 70 and is inserted into the first guiding hole 760 of the interconnecting member 76 attached to the top plate 61. Furthermore, there is a second pin 711 which protrudes from the upper face of the second holder 71 and is inserted into the second guiding hole 761 of the interconnecting member 76 attached to the top plate 61. Additionally, there is a first pin which protrudes from the lower face of the first holder 70 and is inserted into the first guiding hole of the interconnecting member 76 attached to the bottom plate 60. Moreover, there is a second pin which protrudes from the lower face of the second holder 71 and is inserted into the second guiding hole of the interconnecting member 76 attached to the bottom plate 60.

Accordingly, when the second holder 71 moves forward, the second pin 711 also moves forward within the second guiding hole 761. When the second pin 711 moves forward within the second guiding hole 761, the interconnecting member 76 rotates around the bolt 77 counterclockwise. When the interconnecting member 76 rotates counterclockwise, the first pin 700 moves rearward within the first guiding hole 760. Such a rearward movement of the first pin 700 within the first guiding hole 760 causes a rearward movement of the first holder 70. In contrast, when the second holder 71 moves rearward, the second pin 711 also moves rearward within the second guiding hole 761. When the second pin 711 moves rearward within the second guiding hole 761, the interconnecting member 76 rotates around the bolt 77 clockwise. When the interconnecting members 76 rotates clockwise, the first pin 700 moves forward within the first guiding hole 760. Such a forward movement of the first pin 700 with in the first guiding hole 760 causes a forward movement of the first holder 70. As described above, the first holder 70 and the second holder 71 which are interconnected by the interconnecting members 76 move so as to change a distance (interval) between the first holder 70 and the second holder 71. The illuminated area of light (illuminating light) emitted forward through the window hole 710 of the second holder 71 is increased with a decrease in the distance (interval) between the first holder 70 and the second holder 71. In contrast, the illuminated area of illuminating light is decreased with an increase in the distance (interval) between the first holder 70 and the second holder 71. Note that, the first holder 70 and the second holder 71 are moved in the forward and rearward direction in accordance with movements of the handles 74 and 75 in the forward and rearward direction by hand, respectively.

Accordingly, the illuminating device X3 allows movement of the first movable lens array 54, the second movable lens array 55 and the third movable lens array 56 in the forward and rearward direction (a direction parallel to optical axes of the second lenses 530) relative to the casing 6, and therefore it is possible to change an illuminated area easily. Note that, the number of movable lens arrays is not limited to 3, but may be 1 or 2 or 4 or more.

Additionally, the four holes 5213 of the second light control member 521 are formed into an oval shape with a long axis along the left and right direction. The second light control member 521 is allowed to move in the left and right direction while being supported by the four axles 72. When the second light control member 521 is moved its right position, rays of light which have passed through the first light transmission channels 5201 of the first light control member 520 are allowed to pass through the second light transmission channels 5211. In contrast, when the second light control member 521 is moved to its left position, rays of light which have passed through the first light transmission channels 5201 of the first light control member 520 are allowed to pass through the third light transmission channels 5212. Thus, movement of the second light control member 521 in the left and right direction can cause a change in diameters of holes (apertures) for transmitting light. Accordingly, the second light transmission channels 5211 and the third light transmission channels 5212 can be switched, and therefore the illuminating device X3 can change the illuminated area of the illuminating light. Note that, the second light transmission channels 5211 and the third light transmission channels 5212 may be holes with a shape other than a circular shape. For example, when the second light transmission channels 5211 are semicircular holes and the third light transmission channels 5212 are circular holes, the shape of (the illuminated area) of the illuminating light of the illuminating device X3 can be switched between a semicircular shape and a circular shape.

As described above, the illuminating device X3 may preferably include a movable lens array (the first movable lens array 54, the second movable lens array 55, the third movable lens array 56) including movable lenses (the first movable lenses 540, the second movable lenses 550, the third movable lenses) individually corresponding to the second lenses 530. Additionally, the illuminating device X3 may preferably include the moving mechanism 7 configured to move the movable lens array along optical axes of the second lenses 530. Each of the movable lenses (the first movable lenses 540, the second movable lenses 550, the third movable lenses) may preferably be configured to refract the illumination light refracted by a corresponding second lens 530 of the second lenses 530.

When the illuminating device X3 is configured as above, the illuminated area can be easily changed by moving the movable lens array (the first movable lens array 54, the second movable lens array 55, the third movable lens array 56).

As apparent from aforementioned Embodiment 1 and 2, the illuminating device (X1, X2, X3) of the first aspect includes light emitting diodes (100, 500), a first lens array (11, 51), a second lens array (13, 53), and a light control member (12, 52). The first lens array (11, 51) includes first lenses (110) individually corresponding to the light emitting diodes (100, 500). The light control member (12, 52) includes light transmission channels (1201, 1211, 5201, 5211) individually corresponding to the first lenses (110) and a light blocker (1200, 1210, 5200, 5210) surrounding the light transmission channels (1201, 1211, 5201, 5211). The second lens array (13, 53) includes second lenses (130, 530) individually corresponding to the light transmission channels (1201, 1211, 5201, 5211). Each of the first lenses (110) includes a light concentrator (111) for producing concentrated light by concentrating a part of light emitted from a corresponding light emitting diode (100, 500) of the light emitting diodes (100, 500), and a reflector (112) surrounding the light concentrator (111) to produce reflected light by reflecting another part of the light emitted from the corresponding light emitting diode (100, 500) in a direction across the concentrated light and being configured to output illumination light including the concentrated light and the reflected light. Each of the light transmission channels (1201, 1211, 5201, 5211) is for transmitting the illumination light output from a corresponding first lens (110) of the first lenses (110). The light blocker (1200, 1210, 5200, 5210) is for preventing transmission of the illumination light emitted from each of the first lenses (110). Each of the second lenses (130, 530) is for refracting the illumination light transmitted by a corresponding light transmission channel (1201, 1211, 5201, 5211) of the light transmission channels (1201, 1211, 5201, 5211). According to the first aspect, it is possible to improve the usage efficiency of light emitted from light emitting diodes (100, 500) and additionally improve the uniformity ratio of illumination light.

The illuminating device (X1, X2, X3) of the second aspect can be realized in combination with the first aspect. In the second aspect, each of the light transmission channels (1201, 1211, 5201, 5211) includes a first light transmission channel (1201, 5201) and a second light transmission channel (1211, 5211). The first light transmission channel (1201, 5201) faces the first lens array (11, 51) to transmit the illumination light output from a corresponding first lens (110) of the first lenses (110). The second light transmission channel (1211, 5211) faces the second lens array (13, 53) to transmit the illumination light transmitted by the first light transmission channel (1201, 5201). The light blocker includes a first light blocker (1200, 5200) which faces the first lens array (11) and surrounds the first light transmission channel (1201, 5201) of each of the light transmission channels (1201, 1211, 5201, 5211), and a second light blocker (1210, 5210) which faces the second lens array (13, 53) and surrounds the second light transmission channel (1211, 5211) of each of the light transmission channels (1201, 1211, 5201, 5211). According to the second aspect, it is possible to further improve the uniformity ratio of illumination light compared with a case where only a single light blocking member is provided.

The illuminating device (X1, X2, X3) of the third aspect can be realized in combination with the second aspect. In the third aspect, the light control member (the first light control member 120) includes first hollow cylindrical parts (1202) individually surrounding the first light transmission channels (1201). The light control member (the second light control member 121) includes second hollow cylindrical parts (1212) individually surrounding the second light transmission channels (1211). The first hollow cylindrical parts (1202) protrude from the first light blocker (1200) toward the second light blocker (1210). The second hollow cylindrical parts (1212) protrude from the second light blocker (1210) toward the first light blocker (1200). According to the third aspect, it is possible to further improve the uniformity ratio of illumination light compared with a case where the first hollow cylindrical parts (1202) and the second hollow cylindrical parts (1212) are not provided.

The illuminating device (X1, X3) of the fourth aspect can be realized in combination with the third aspect. In the fourth aspect, the first hollow cylindrical parts (1202) and the second hollow cylindrical parts (1212) face each other and are separated by a predetermined distance (d1). According to the fourth aspect, it is possible to suppress an increase in temperature of the second hollow cylindrical parts (1212) even if sunlight enters the illuminating device (X1, X3) through the second lenses (130).

The illuminating device (X1, X3) of the fifth aspect can be realized in combination with the fourth aspect. In the fifth aspect, each of the first hollow cylindrical parts (1202) has a surface having a color which absorbs less sunlight than black. According to the fifth aspect, it is possible to suppress an increase in temperature of the first hollow cylindrical parts (1202) even if sunlight enters the illuminating device (X1, X3) through the second lenses (130).

The illuminating device (X1, X2, X3) of the sixth aspect can be realized in combination with any one of the third to fifth aspects. In the sixth aspect, in each of the light transmission channels, at least one of the first light transmission channel (1201) and the second light transmission channel (1211) has a shape configured to partially block the illumination light output from a corresponding first lens (110) of the first lenses (110). According to the sixth aspect, a shape of the illuminating light emitted through the second lenses (130) can be easily changed by changing in shapes of the first light transmission channels (1201) and the second light transmission channels (1211).

The illuminating device (X2) of the seventh aspect can be realized in combination with the third aspect. In the seventh aspect, the first hollow cylindrical parts (1202) and the second hollow cylindrical parts (1212) face each other and are in contact.

The illuminating device (X1, X2, X3) of the eighth aspect can be realized in combination with the third aspect. In the eighth aspect, each of the first hollow cylindrical parts (1202) has a diameter which becomes smaller as a distance from the first light blocker (1200) increases.

The illuminating device (X1, X2, X3) of the ninth aspect can be realized in combination with the eighth aspect. In the ninth aspect, each of the second hollow cylindrical parts (1212) has a diameter which becomes smaller as a distance from the second light blocker (1210) increases.

The illuminating device (X1, X2, X3) of the tenth aspect can be realized in combination with the second aspect. In the tenth aspect, at least one of the first light transmission channel (1201) and the second light transmission channel (1211) of each of the light transmission channels (1201, 1211) includes a non-circular through-hole.

The illuminating device (X3) of the eleventh aspect can be realized in combination with the first or second aspect. The eleventh aspect includes a movable lens array (the first movable lens array 54, the second movable lens array 55, the third movable lens array 56) including movable lenses (the first movable lenses 540, the second movable lenses 550, the third movable lenses) individually corresponding to the second lenses (130, 530). Additionally, the seventh aspect includes a moving mechanism (7) configured to move the movable lens array along optical axes of the second lenses (130, 530). Each of the movable lenses (the first movable lenses 540, the second movable lenses 550, the third movable lenses) may preferably be configured to refract the illumination light refracted by a corresponding second lens (130, 530) of the second lenses (130, 530). According to the eleventh aspect, the illuminated area can be easily changed by moving the movable lens array (the first movable lens array 54, the second movable lens array 55, the third movable lens array 56).

The illuminating device (X1, X2, X3) of the twelfth aspect can be realized in combination with the first aspect. In the twelfth aspect, the reflector (112) surrounds a light entrance surface (111*a*) of the light concentrator (111).

The illuminating device (X1, X2, X3) of the thirteenth aspect can be realized in combination with the first aspect. In the thirteenth aspect, the light blocker (1200, 1210, 5200, 5210) has a flat plate shape of material. The light transmission channels (1201, 1211, 5201, 5211) have circular through-holes penetrating the light blocker (1200, 1210, 5200, 5210).

The illuminating device (X1, X2, X3) of the fourteenth aspect can be realized in combination with the first aspect.

In the fourteenth aspect, the light blocker (1200, 1210, 5200, 5210) has a flat plate shape of material. The light transmission channels (1201, 1211, 5201, 5211) have non-circular through-holes penetrating the light blocker (1200, 1210, 5200, 5210).

The illuminating device (X1, X2, X3) of the fifteenth aspect can be realized in combination with any one of the first to fourteenth aspects. In the fifteenth aspect, in each of the first lenses (110), the light concentrator (111) and the reflector (112) are formed integrally.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illuminating device, comprising:

light emitting diodes;

a first lens array including first lenses individually corresponding to the light emitting diodes;

a light control member including light transmission channels individually corresponding to the first lenses and a light blocker surrounding the light transmission channels; and a second lens array including second lenses individually corresponding to the light transmission channels, each of the first lenses including:

a light concentrator for producing concentrated light by concentrating a part of light emitted from a corresponding light emitting diode of the light emitting diodes; and a reflector surrounding the light concentrator to produce reflected light by reflecting another part of the light emitted from the corresponding light emitting diode in a direction across the concentrated light, each of the first lenses being configured to output illumination light including the concentrated light and the reflected light produced from the corresponding light emitting diode, each of the light transmission channels including:

a first light transmission channel facing the first lens array to transmit the illumination light output from a corresponding first lens of the first lenses; and a second light transmission channel facing the second lens array to transmit the illumination light transmitted by the first light transmission channel, each of the light transmission channels being configured to transmit the illumination light output from a corresponding first lens of the first lenses, the light blocker including:

a first light blocker which faces the first lens array and surrounds the first light transmission channel of each of the light transmission channels; and a second light blocker which faces the second lens array and surrounds the second light transmission channel of each of the light transmission channels, the light blocker being configured to prevent transmission of the illumination light emitted from each of the first lenses, and each of the second lenses being configured to refract the illumination light transmitted by a corresponding light transmission channel of the light transmission channels.

2. The illuminating device of claim 1, wherein the light control member includes:

first hollow cylindrical parts individually surrounding the first light transmission channels; and second hollow cylindrical parts individually surrounding the second light transmission channels, the first hollow cylindrical parts protrude from the first light blocker toward the second light blocker, and the second hollow cylindrical parts protrude from the second light blocker toward the first light blocker.

3. The illuminating device of claim 2, wherein the first hollow cylindrical parts and the second hollow cylindrical parts face each other and are separated by a predetermined distance.

4. The illuminating device of claim 3, wherein each of the first hollow cylindrical parts has a surface having a color which absorbs less sunlight than black.

5. The illuminating device of claim 4, wherein in each of the light transmission channels, at least one of the first light transmission channel and the second light transmission channel has a shape configured to partially block the illumination light output from a corresponding first lens of the first lenses.

6. The illuminating device of claim 3, wherein in each of the light transmission channels, at least one of the first light transmission channel and the second light transmission channel has a shape configured to partially block the illumination light output from a corresponding first lens of the first lenses.

7. The illuminating device of claim 2, wherein in each of the light transmission channels, at least one of the first light transmission channel and the second light transmission channel has a shape configured to partially block the illumination light output from a corresponding first lens of the first lenses.

8. The illuminating device of claim 2, wherein the first hollow cylindrical parts and the second hollow cylindrical parts face each other and are in contact.

9. The illuminating device of claim 2, wherein each of the first hollow cylindrical parts has a diameter which becomes smaller as a distance from the first light blocker increases.

10. The illuminating device of claim 9, wherein each of the second hollow cylindrical parts has a diameter which becomes smaller as a distance from the second light blocker increases.

11. The illuminating device of claim 1, wherein at least one of the first light transmission channel and the second light transmission channel of each of the light transmission channels comprises a non-circular through-hole.

12. The illuminating device of claim 1, further comprising:

a movable lens array including movable lenses individually corresponding to the second lenses; and a moving mechanism configured to move the movable lens array along optical axes of the second lenses, wherein each of the movable lenses is configured to refract the illumination light refracted by a corresponding second lens of the second lenses.

13. The illuminating device of claim 1, wherein the reflector surrounds a light entrance surface of the light concentrator.

14. The illuminating device of claim 1, wherein the light blocker comprises a flat plate shape of material, and the light transmission channels comprise circular through-holes penetrating the light blocker.

15. The illuminating device of claim 1, wherein the light blocker comprises a flat plate shape of material, and the light transmission channels comprise non-circular through-holes penetrating the light blocker.

16. The illuminating device of claim 1, wherein in each of the first lenses, the concentrator and the reflector are formed integrally.

* * * * *